US009406493B2

(12) United States Patent
Verenchikov

(10) Patent No.: US 9,406,493 B2
(45) **Date of Patent: *Aug. 2, 2016**

(54) ELECTROSTATIC MASS SPECTROMETER WITH ENCODED FREQUENT PULSES

(71) Applicant: LECO Corporation, St. Joseph, MI (US)

(72) Inventor: Anatoly N. Verenchikov, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/506,270

(22) Filed: Oct. 3, 2014

(65) Prior Publication Data

US 2015/0021471 A1 Jan. 22, 2015

Related U.S. Application Data

(63) Continuation of application No. 13/695,388, filed as application No. PCT/IB2011/051617 on Apr. 14, 2011, now Pat. No. 8,853,623.

(30) Foreign Application Priority Data

Apr. 30, 2010 (GB) ..... 1007210.6

(51) Int. Cl.
*H01J 49/00* (2006.01)
*H01J 49/40* (2006.01)
*H01J 49/22* (2006.01)

(52) U.S. Cl.
CPC ..... *H01J 49/40* (2013.01); *H01J 49/0031* (2013.01); *H01J 49/0036* (2013.01); *H01J 49/22* (2013.01); *H01J 49/401* (2013.01); *H01J 49/406* (2013.01)

(58) Field of Classification Search
CPC ..... H01J 49/40; H01J 49/004; H01J 49/0027; H01J 49/0081; H01J 49/061; H01J 49/147; H01J 49/282; H01J 49/401; H01J 49/4245
USPC ..... 250/281, 282, 286, 287, 288, 289, 290
See application file for complete search history.

(56) References Cited

U.S. PATENT DOCUMENTS 5,396,065 A 3/1995 Myerholtz et al.
6,300,626 B1 10/2001 Brock et al.

(Continued)

FOREIGN PATENT DOCUMENTS

CN 1689134 A 10/2005
GB 2300296 A 10/1996

(Continued)

OTHER PUBLICATIONS

Office Action issued by Japanese Patent Office relating to Japanese Patent Application No. 2013-506778.

(Continued)

*Primary Examiner* — Nicole Ippolito
*Assistant Examiner* — Hanway Chang
(74) *Attorney, Agent, or Firm* — Honigman Miller Schwartz and Cohn LLP

(57) ABSTRACT

A method, apparatus and algorithms are disclosed for operating an open electrostatic trap (E-trap) or a multi-pass TOF mass spectrometer with an extended flight path. A string of start pulses with non equal time intervals is employed for triggering ion packet injection into the analyzer, a long spectrum is acquired to accept ions from the entire string and a true spectrum is reconstructed by eliminating or accounting overlapping signals at the data analysis stage while using logical analysis of peak groups. The method is particularly useful for tandem mass spectrometry wherein spectra are sparse. The method improves the duty cycle, the dynamic range and the space charge throughput of the analyzer and of the detector, so as the response time of the E-trap analyzer. It allows flight extension without degrading E-trap sensitivity.

23 Claims, 9 Drawing Sheets

(56) References Cited

U.S. PATENT DOCUMENTS

| | | | | |
|---|---|---|---|---|
| 8,853,623 | B2 * | 10/2014 | Verenchikov | 250/287 |
| 2005/0194528 | A1 | 9/2005 | Yamaguchi et al. | |
| 2007/0187585 | A1 * | 8/2007 | Verentchikov | 250/287 |
| 2013/0056627 | A1 * | 3/2013 | Verenchikov | 250/282 |

FOREIGN PATENT DOCUMENTS

| | | | |
|---|---|---|---|
| JP | 2009-512162 | A | 3/2009 |
| WO | WO-2007044696 | A1 | 4/2007 |

OTHER PUBLICATIONS

Office Action issued by Canadian Patent Office relating to Canadian Patent Application No. 2800298 dated Feb. 25, 2014.
Office Action issued by German Patent Office relating to German Patent Application No. 112011101514.3 dated Mar. 24, 2014.
International Search Report relating to PCT/IB2011/051617 dated Aug. 24, 2011.
Office Action issued by the U.S. Patent and Trademark Office relating to U.S. Appl. No. 13/695,388 dated Jan. 15, 2014.
Office Action issued by Chinese Patent Office relating to Chinese Patent Application No. 201180021662.1.

* cited by examiner

*FIG. 1 PRIOR ART, GB2403063*

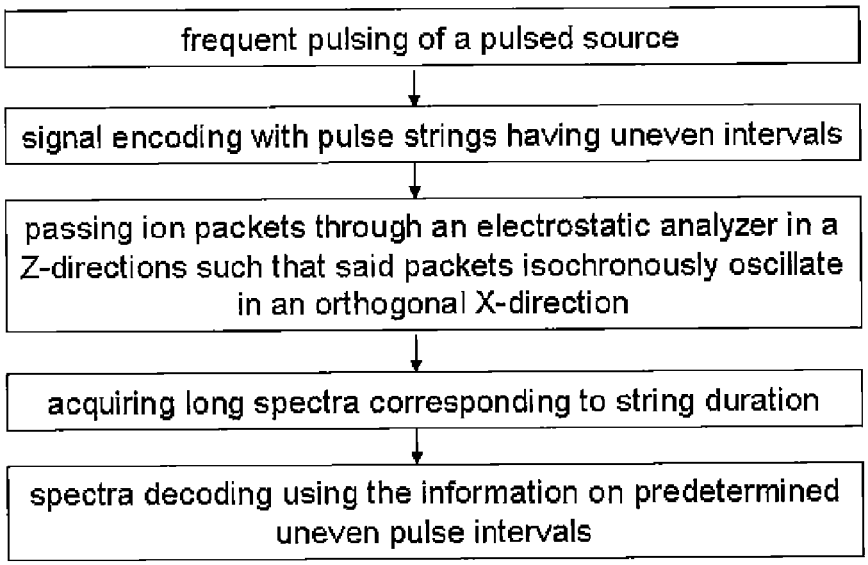
*Fig.5 –Method*
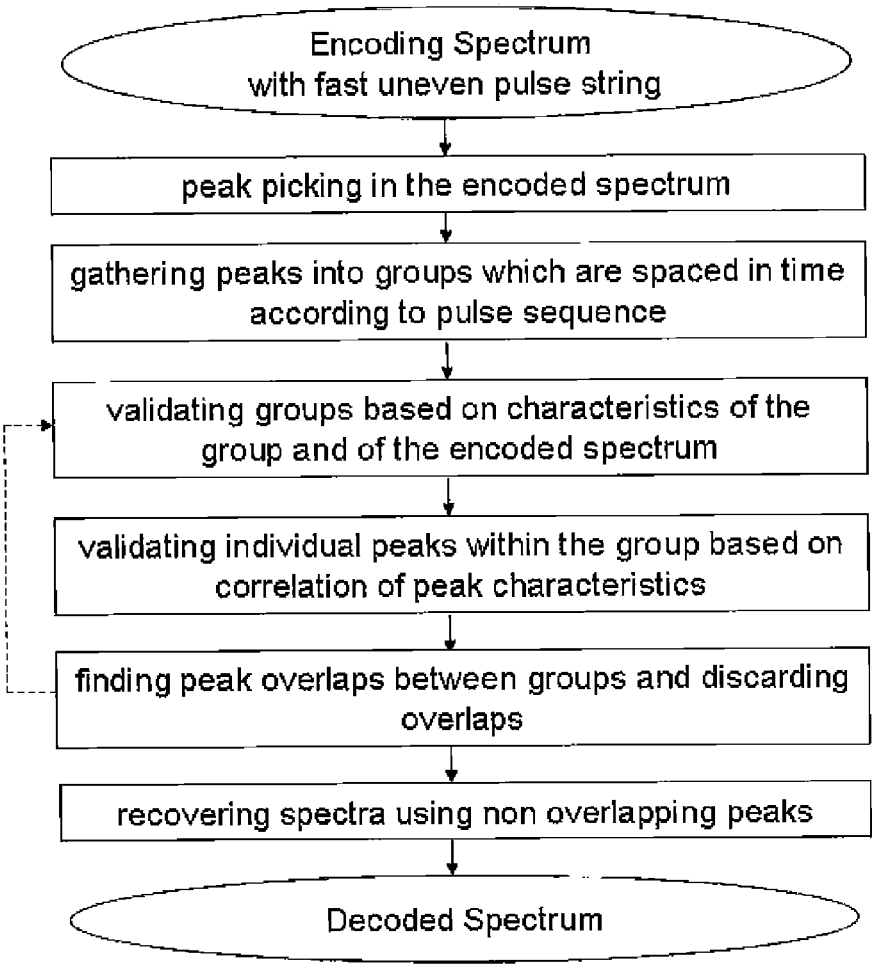
*Fig.6 – Algorithm*

ELECTROSTATIC MASS SPECTROMETER WITH ENCODED FREQUENT PULSES

RELATED APPLICATIONS

This application is a continuation of U.S. patent application Ser. No. 13/695,388 filed on Oct. 30, 2012, which is now U.S. Pat. No. 8,853,623, which in turn was a national stage entry of PCT/IB2011/051617 filed on Apr. 14, 2011, wherein the contents of the abovementioned applications are hereby incorporated by reference in their entirety.

FIELD OF THE INVENTION

The invention generally relates to the area of mass spectroscopic analysis, and more in particularly is concerned with improving sensitivity, speed and dynamic range in the electrostatic mass spectrometer apparatuses including open electrostatic traps or time-of-flight mass spectrometers with an extended flight path.

STATE OF THE ART

Time-of-flight mass spectrometers (TOF MS) are widely used in analytical chemistry for identification and quantitative analysis of various mixtures. Sensitivity and resolution of such analysis is an important concern for practical use. To increase resolution of TOF MS, U.S. Pat. No. 4,072,862, incorporated herein by reference, discloses an ion mirror for improving time-of-flight focusing in respect to ion energy. To employ TOF MS for continuous ion beams, WO9103071, incorporated herein by reference, discloses a scheme of orthogonal pulsed acceleration (OA). Since resolution of TOF MS scales with the flight path, there have been suggested multi-pass time-of-flight mass spectrometers (M-TOF MS) including multi-reflecting (MR-TOF) and multi-turn (MT-TOF) mass spectrometers. SU1725289, incorporated herein by reference, introduces a folded path MR-TOF MS using two-dimensional gridless and planar ion mirrors. GB2403063 and U.S. Pat. No. 5,017,780, incorporated herein by reference, disclose a set of periodic lenses for spatial confinement of ion packets within the two-dimensional MR-TOF. WO2007044696, incorporated herein by reference, suggests a scheme with double orthogonal injection for improving OA efficiency. Still, the duty cycle of OA-MR-TOF remains under 1%.

To improve OA duty cycle, temporal compression of ion beam in the OA can be achieved by ion accumulation and pulsed release from a linear ion guide (U.S. Pat. No. 5,689,111, U.S. Pat. No. 6,020,586, and U.S. Pat. No. 730,986, incorporated herein by reference), by using a mass dependent ion release out of the ion trap (U.S. Pat. No. 6,504,148, U.S. Pat. No. 6,794,640, WO2005106921 and U.S. Pat. No. 7,582,864, incorporated herein by reference), or by an ion velocity modulation within an RF ion guide (WO2007044696, incorporated herein by reference). However, the compression causes the following problems (a) restriction of mass range; (b) saturation of the detecting system; and (c) expansion of ion packets within the analyzer due to self space charge. Space charge effects are known to limit ion packets in M-TOF to less than 1000 ions per shot per peak and under 1 E+6 ions per mass peak per second. This is much lower than can be generated by modern ion sources: 1 E+9 ions/sec in case of Electrospray (ESI), APPI and APCI ion sources, 1 E+10 ions/sec in case of EI and glow discharge (GD) ion sources and 1 E+11 ions/sec in case of ICP ion sources.

To improve OA duty cycle, U.S. Pat. No. 6,861,645, incorporated herein by reference, discloses a method of using short pulsing period, recording short spectra, and decoding spectra through the form of peaks width and peak patterns, like isotopic distribution or the pattern of multiply charged peaks. WO2008087389, incorporated herein by reference, discloses fast OA pulsing, recording and comparing at least two sets of data with different period of OA pulses. Both methods work only for low populated spectra with intense peaks.

U.S. Pat. No. 6,900,431, incorporated herein by reference, discloses method of Hadamard Transformation (HT) in combination with orthogonal acceleration TOF MS (o-TOF MS). Frequent pulses of orthogonal accelerator (OA) are arranged in 'pseudorandom' sequence, as a periodic sequence with predetermined binary encoded omissions, and spectra are recovered by the reverse HT. The reverse HT procedure includes summing and subtracting of the same long spectrum while shifting the spectrum according to encoding sequence. However, the method suffers additional noise originating at reverse HT. Due to variations of ion source flux and of detector response, an intended subtraction of equal signals in fact leaves bogus peaks in the recovered spectra.

The co-pending application PCT/IB2010/056136, incorporated herein by reference, discloses an open E-trap with an extended but not fixed ion path. Ions are pulsed injected via an elongated pulsed converter for multiple oscillation cycles (reflections between ion mirrors or turns within electrostatic sectors) and arrive onto a detector after an integer number M of oscillations within some span ΔM. In the resultant spectrum each m/z component is presented by peak multiplets corresponding to a span in the integer number of oscillations. The spectra recovery accounts a reproducible intensity distribution within multiplets. The application also proposes a combination of fast pulsing with multiplets recording. However, the proposed start pulse string employs a constant time intervals between the pulses, which limits the ability of raw spectra decoding.

Herein we propose the term 'Electrostatic mass spectrometers' (EMS) to denote both—Open Electrostatic Traps (E-traps) with an extended and non-fixed ion path and Multi-pass Time-of-flight electrostatic (E-TOF) mass spectrometers.

Summarizing the above, the prior art EMS enhance resolution but limit the duty cycle of pulsed converters and can not accept large ion flows above 1 E+7 ions a second from modern ion sources without degrading analyzer parameters. Prior art methods of improving OA duty cycle are not suited for EMS. Therefore, there is a need for improving sensitivity, speed, dynamic range, and ion throughput of EMS.

SUMMARY OF THE INVENTION

The inventors have realized that sensitivity, dynamic range and response time of high resolving Electrostatic Mass Spectrometers (EMS) could be substantially improved by (a) fast pulsing of an ion source or a pulsed converter, (b) making predetermined pulse sequence with unique time intervals between any pair of pulses which is referred herein as pulse coding, (c) acquiring long spectra for a string of fast pulses, and (d) decoding such spectra using logical analysis of peak overlaps at the stage of data analysis while employing the information on pulse intervals and on the experimentally determined intensity distribution within multiplets.

Contrary to prior art, the pulses are coded with unequal pulse intervals. Thus, in the long coded spectrum there may appear a single overlap between various mass (m/z) components corresponding to different start pulses, but the method avoids systematic overlaps for any pair of m/z components and particular multiplet peaks. At moderate spectral population (percentage of the occupied time scale), the majority of peaks for single mass (m/z) component will be free of overlaps and would be used for summing of the signal. Non periodic pulses also provide sharp resonance for correct mass (m/z) hypothesis, while false hypotheses would have fewer coincidences (analogy to puzzle pieces). The logically found overlaps are either removed or accounted before the peak summation.

The method is primarily applied to tandem mass spectrometry wherein spectra are sparse and have low chemical background. In the broad sense, we define tandem mass spectrometer is a combination of EMS with any gas phase ionic separating device, such as differential ion mobility spectrometer, mobility spectrometer or a mass spectrometer with fragmentation cell.

The application discloses a novel EMS apparatus with encoded fast pulsing and with a spectral decoder. Some particular embodiments illustrate the advantages of novel apparatus and of the novel encoding-decoding method. The application discloses multiple novel algorithms for spectra recovery and presents simulated results of spectra recovery based on the model MS-MS spectra with at least 100 mass components.

According to the first aspect of the invention there is provided an electrostatic mass spectrometer (EMS) comprising:

(a) A pulsed ion source for ion packet formation;
(b) An ion detector;
(c) A multi-pass EMS analyzer providing an ion packet passage though said analyzer in a Z-direction and isochronous ion oscillations in the orthogonal direction X;
(d) A pulse string generator for triggering said pulsed ion source or pulsed converter with time intervals between any pair of start pulses being unique within the peak time width $\Delta T$ on the detector;
(e) A data acquisition system for recording of detector signal at the duration of said pulse string and for summing spectra corresponding to multiple pulse strings;
(f) A main pulse generator for triggering both—said data acquisition system and said pulse string generator; and
(g) A spectral decoder for reconstructing mass spectra based on the detector signal and on the information on the preset time intervals of said start pulses.

Preferably, within the pulse string, for any non equal numbers of start pulses i and j, the start times $T_i$ and $T_j$ satisfy one condition of the group: (i) $|(T_{i+1}-T_i)-(T_{j+1}-T_j)|>\Delta T$; (ii) $T_j=j*(T_1+T_2*(j-1))$, wherein 1 us$<T_1<$100 us and 5 ns$<T_2<$1000 ns. The number S of start pulses in the pulse string may be as low as 3, or above 300. The ratio between the duration of said pulse string and an average flight time of the heaviest m/z ions may be as low as 0.1, or above 10.

In one embodiment, the electrodes of said multi-pass EMS analyzer are parallel and are linearly extended in the Z-direction to form a two-dimensional electrostatic filed of planar symmetry. In another embodiment, said EMS analyzer comprises parallel and coaxial ring electrodes to form a toroidal volume with a two-dimensional electrostatic filed of cylindrical symmetry. Preferably, the mean diameter of said toroidal volume is larger than one third of ion path per single oscillation and wherein said analyzer has at least one ring electrode for radial ion deflection. Preferably, the arcuate ion displacement per single reflection is less than 3 degree. Said EMS analyzer may comprise one set of electrodes of the group: (i) at least two electrostatic ion mirrors; (ii) at least two electrostatic sectors; and (iii) at least one ion mirror and at least one electrostatic sector.

In one group of embodiments, said EMS analyzer may be an open E-trap with a non fixed ion path and wherein the number of ion oscillations M in said analyzer may have a span $\Delta M$ as low as 2, and up to 100. Preferably, said number of oscillations M may vary from 3 and exceed 100. Preferably, the number of pulses S in said string of start pulses may be adjusted depending on the spread in the number of oscillations $\Delta M$, such that total number of peaks in the coded raw spectrum being a product of $\Delta M*S$ may vary from 3 to 100. Preferably, said electrostatic field of said E-trap analyzer is adjusted to provide ion packet time focusing at a detector plane $X=X_D$ for every ion cycle. In another group of embodiments, said EMS analyzer comprises may be a multi-pass time-of-flight mass analyzer with a fixed ion path. Said multi-pass TOF analyzer may have one means for limiting ion divergence in the Z-direction of the group: (i) a set of periodic lens; (ii) electrostatic mirror or electrostatic sector modulated in the Z-direction; and (iii) at least two slits.

In one embodiment, said pulsed ion source may comprise one intrinsically pulsed source of the group: (i) a MALDI source; (ii) a DE MALDI source; (iii) a fragmentation cell with pulsed extraction; (iv) an electron impact with pulsed extraction; and (iv) a SIMS source. In another embodiment, in order to adopt continuous ion sources, said pulsed source may comprise one orthogonal pulsed accelerator (OA) of the group: (i) an orthogonal pulsed accelerator; (ii) a grid-free orthogonal pulsed accelerator; (iii) a radiofrequency ion guide with pulsed orthogonal extraction; (iv) an electrostatic ion guide with pulsed orthogonal extraction; and (v) any of the above accelerators preceded by an upstream accumulating radio-frequency ion guide. Preferably, the ion extraction from said upstream gaseous RF ion guide may be synchronized by said main generator triggering said pulse string, and wherein the duration of said pulse string is chosen comparable to the spread in ion arrival time into said OA. Said OA may be longer than ion packet displacement $Z_1$ per single ion cycle in E-trap EMS analyzer. Said OA may be displaced from the X-Z symmetry axis of said analyzer; and wherein ion packets are returned onto said X-Z symmetry axis by a pulsed deflector. Said OA may be tilted relative to Z axis and an additional deflector steers ion packets at the same angle after at least one ion reflection or turn within said EMS analyzer.

Said data acquisition system may comprise an ADC or a TDC, either with an on-board spectra summation or with data transfer via bus in a data logging regime, wherein the digitized signal above threshold passes via a memory buffer and via an interface bus, while the signal analysis and summation are implemented within a PC. Said spectral decoder may comprise a multi-core PC. Alternatively, said spectral decoder may be implemented on data acquisition board in fast programmable gate array for multi-core parallel spectral decoding.

The invention is applicable to various tandems. Preferably, the apparatus may further comprise an upstream chromatograph for sample separation prior to EMS. The apparatus may further comprise such prior ion separating means as: (i) an ion mobility spectrometer, (ii) a differential mobility spectrometer; and (iii) a mass filter; (iv) a sequential separator as an ion trap with sequential ion ejection or a trap followed by a time-of-flight mass spectrometer; and (vi) any of above ion separation means followed by a fragmentation cell. The apparatus with up-front separation means may further comprise an additional encoding generator for providing second string of encoded start pulses to trigger said upfront separation means.

According to the second aspect of the invention there is provided a method of mass spectral analysis comprising the following steps:

(a) frequent pulsing of a pulsed source;
(b) signal encoding with pulse strings having uneven intervals;
(c) passing ion packets through an electrostatic analyzer in a Z-directions such that said packets isochronously oscillate in an orthogonal X-direction;
(d) acquiring long spectra corresponding to string duration; and
(e) spectra decoding using the information on predetermined uneven pulse intervals.

The method may further comprise one step of the group: (i) discarding peaks overlapping between series; and (ii) separating partially overlapping peaks based on the information deduced from the non overlapping peaks in related series and assigning thus separated peaks to the related series. Preferably, within the pulse string, for any non equal numbers of start pulses i and j, start times $T_i$ and $T_j$ satisfy one condition of the group: (i) $|(T_{i+1}-T_i)-(T_{j+1}-T_j)|>\Delta T$; (ii) $T_j=i*(T_1+T_2*(j-1))$, where $T_1>>T_2$; (iii) wherein $T_1$ is from 10 to 100 us and $T_2$ is from 5 to 100 ns. Alternatively, the time of pulse $T_i$ with number i is defined as $T_i=i*T_1+T_2*j*(j-1)$, wherein integer index j is varied such that to smooth the course of interval variations. The number of start pulses S in said pulse string may be as low as 3 and up to 1000.

In one group of methods (open E-trap mass spectrometry), said ion packets may be injected into said electrostatic field at an angle to said X-axis such that an ion path with the analyzer is equal to an integer number of oscillations M within a span ΔM varying from 2 to at least 100. Said number of reflections M may be 3, or up to 1000. The number of pulses S in said string of start pulses may be adjusted depending on the spread in the number of reflections ΔM, such that total number of peaks in the coded raw spectrum N=ΔM*S may be 3, or up to 100. The ion flight time in said electrostatic field may be as low as 0.1 ms, or up to 10 ms. The ion flight path in said electrostatic field may be as low as 3 m or up to 100 m. Preferably, said pulsed source and said analyzer field may be adjusted to provide ion packet time focusing at a detector plane $X=X_D$ for every ion cycle.

In another group of methods (M-TOF mass spectrometry), the ion path within the EMS analyzer is fixed by adjusting parameters of the ion pulsed source and of the EMS analyzer. The method comprises at least one step of the group: (i) adjusting source emittance under 20 mm2*eV; (ii) accelerating of ions to potential above 3 kV to provide angular-spatial divergence of less than 20 mm*mrad; (iii) adjusting the packet divergence by at least one lens to less than 1 mrad; (iv) limiting angular divergence by at least two slits within said EMS analyzer or by a set of periodic lenses.

The method is applicable for various electrostatic fields of electrostatic analyzers. Preferably, said electrostatic analyzer field may comprise at least one electrostatic field of the group: (i) electrostatic field of ion mirror providing ion reflections in the X-direction and spatial ion focusing in the Y-direction; (ii) cylindrical deflecting electrostatic field providing ion trajectory looping; (iii) a field-free space; and (iv) a radial symmetric field for orbital ion trapping. Said electrostatic analyzer filed may be two-dimensional of planar symmetry and be linearly extended in the Z-direction. Alternatively, said electrostatic analyzer filed may be two-dimensional of cylindrical symmetry and be circularly extended along the circular Z-axis.

Preferably, said analyzer field is formed by at least four electrodes with distinct potentials, wherein said field comprises at least one spatial focusing field of an accelerating lens such that to provide a time-of-flight focusing along the central ion trajectory relative to small deviations in spatial, angular, and energy spreads of ion packets to an $n^{th}$ order of the Tailor expansion and wherein said order of the aberration compensation may be one of the group: (i) at least first-order; (ii) at least second-order relative to all spreads and including cross terms; and (iii) at least third-order relative to energy spread of ion packets.

The method is compatible to variety of pulsed ionization methods like: (i) MALDI; (ii) DE MALDI; (iii) a SIMS; (iv) a LD; and (v) an EI ionization with pulsed extraction. Alternatively, said step of ion packet formation may comprise a formation of continuous or quasi-continuous ion beam followed by one method of orthogonal pulsed acceleration of the group: (i) an ion injection into a field-free region followed by an orthogonal pulsed acceleration; (ii) an ion propagation through an RF ion guide followed by a pulsed orthogonal extraction; (iii) an ion trapping in an RF ion guide followed by an orthogonal ion extraction; and (iv) an ion beam propagation through an electrostatic ion guide with a pulsed orthogonal extraction. Said step of orthogonal ion acceleration may be preceded by a step of ion accumulation and pulsed extraction of an ion bunch from an RF ion guide being synchronized with the said main generator. Preferably, the duration of the encoded pulse string is comparable to the spread in ion arrival time into said orthogonal accelerator region. Said orthogonal accelerator region may be longer than ion packet displacement $Z_1$ per single ion cycle in the E-trap analyzer for improving duty cycle. Preferably, said orthogonal accelerator region may be displaced from a central ion trajectory plane (or surface); and wherein ion packets are returned onto said surface by a pulsed deflection.

The method is particularly suited for tandem mass spectrometric analyses. Spectral decoding is more accurate when spectra are sparse. Besides, fast pulsing allows rapid tracking of ion content in-front of the EMS. Preferably, the method may further comprise a step of sample chromatographic separation prior to ionization step. Preferably, prior to said step of pulsed packets formation, the method may further comprise one step of ion separation of the group: (i) an ion mobility separation; (ii) a differential mobility separation; (iii) a parent ion mass filter; (iv) an ion trapping followed by mass dependent sequential release; (v) an ion trapping with a time-of-flight mass separation; and (vi) any of the above separation methods followed by a step of ion fragmentation. The step of prior ion separation may further comprise a step of an additional encoding with a second string of start pulses for synchronizing said step of the upfront ion separation; said second string has non equal intervals between pulses; the duration of said second string is comparable to the duration of said upfront ion separation and wherein main pulse period is synchronizing the second string and the data acquisition. Preferably, the method may further comprise steps of ion accumulation and of the pulsed extraction out of either accumulating RF ion guide or fragmentation cell. Preferably, said pulsed extraction is synchronized with the beginning of said start pulse string and the string duration is adjusted according to the ion packet duration.

According to the third aspect of the invention there is provided an algorithm for spectra decoding in multiple-pass electrostatic mass spectrometry with encoded fast pulsing; the algorithm comprising the following steps:
(a) peak picking in the encoded spectrum;
(b) gathering peaks into groups which are spaced in time according to the pulse sequence and or due to multiplet formation;
(c) validating groups based on characteristics of the group and on of the encoded spectrum;

(d) validating individual peaks within the group based on correlation of peak characteristics;
(e) finding peak overlaps between groups and discarding overlaps; and
(f) recovering spectra using non overlapping peaks.

Preferably, the peaks may be sorted into ranges of peak intensity, and wherein identified peaks of higher intensity are removed at analysis of lower range spectra. Said step of group validation may comprise an automatic choice of algorithm parameters based on the dynamic range of the encoded signal and on the degree of spectra population within each range of intensity. Said step of group validation may comprise computation of the valid group criteria: (i) a minimal number of peaks within a group for confirmation of the group; (ii) an acceptable spread in peak intensity; and (iii) an acceptable time deviation and width deviation between peaks within a group. Said step of peak validation within a group may comprise an analysis of in-group distribution for consistency in peak intensity, peak width and deviation of centroid and in-group correlation. Preferably, the algorithm further comprises at least one additional step of the group: (i) background subtraction in tandem mass spectrometry spectra prior to spectra decoding; (ii) deconvolution of chromato-mass spectrometric data prior to spectra decoding. The speed of spectra processing may be enhanced by parallel multi core decoding either of separate spectra or at any decoding step.

According to the fourth aspect of the invention there is provided an algorithm for decoding of low intensity spectra in multi-reflecting mass spectrometry with fast encoded pulsing; the decoding algorithm comprising the following steps:
(a) summing signals spaced according to start pulse intervals for every bin in decoded spectrum;
(b) rejecting sums which has number of non zero signals below a preset threshold;
(c) peak detection in the summed spectrum to form hypotheses of correct peaks;
(d) gathering group of signals corresponding to each hypothesis from the encoded spectrum;
(e) validating groups based on integral characteristics of encoded spectrum;
(f) finding peak overlaps between groups and discarding overlaps;
(g) reconstructing correct spectra using non overlapping signals; and
(h) further reconstructing spectra accounting peak distribution within multiplets.

Preferably, the decision on the applying the algorithm is made automatically by confirming that the analyzed encoded spectra have signals in the range from 0.1 to 100 ions per peak per encoding start. Said step of group validation may comprise one step of the group: (i) automatic calculation of a minimal number of peaks in the group, said acceptance threshold being automatically determined based on encoded spectrum statistics and intensity distribution of signals; (ii) analyzing of signal repetition frequency within the summed binned group and a step of calculating statistical probability of the observed signals intensity and timing spreads. Said bin by bin summation may account signals spreading into the next pulse string (spectrum overtake). Said summing step may be accelerated by grouping bins into larger size bins with the width roughly corresponding to peak width.

Various embodiments of the present invention together with arrangement given illustrative purposes only will now be described, by way of example only, and with reference to the accompanying drawings in which.

Figure 4:
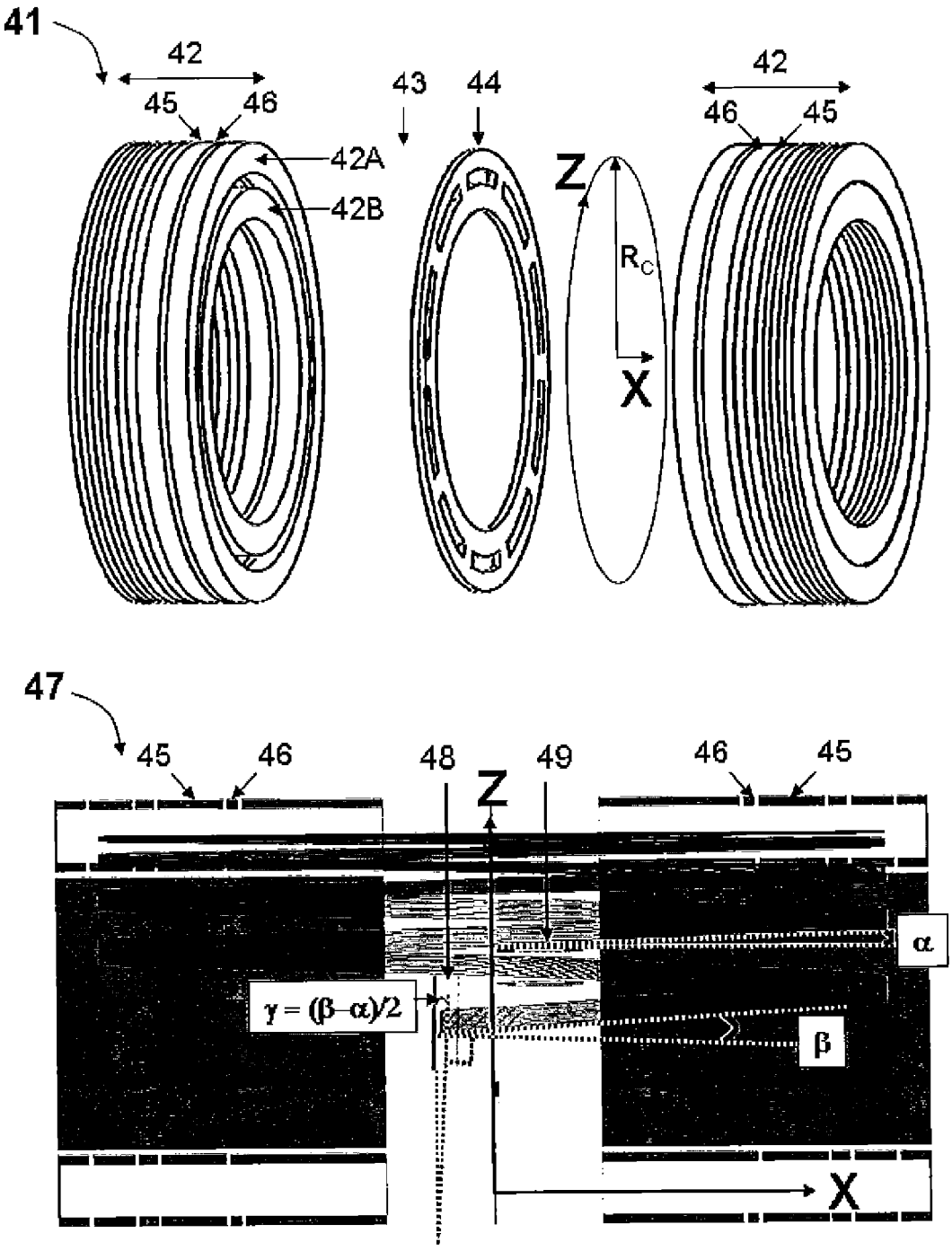
Figure 7:
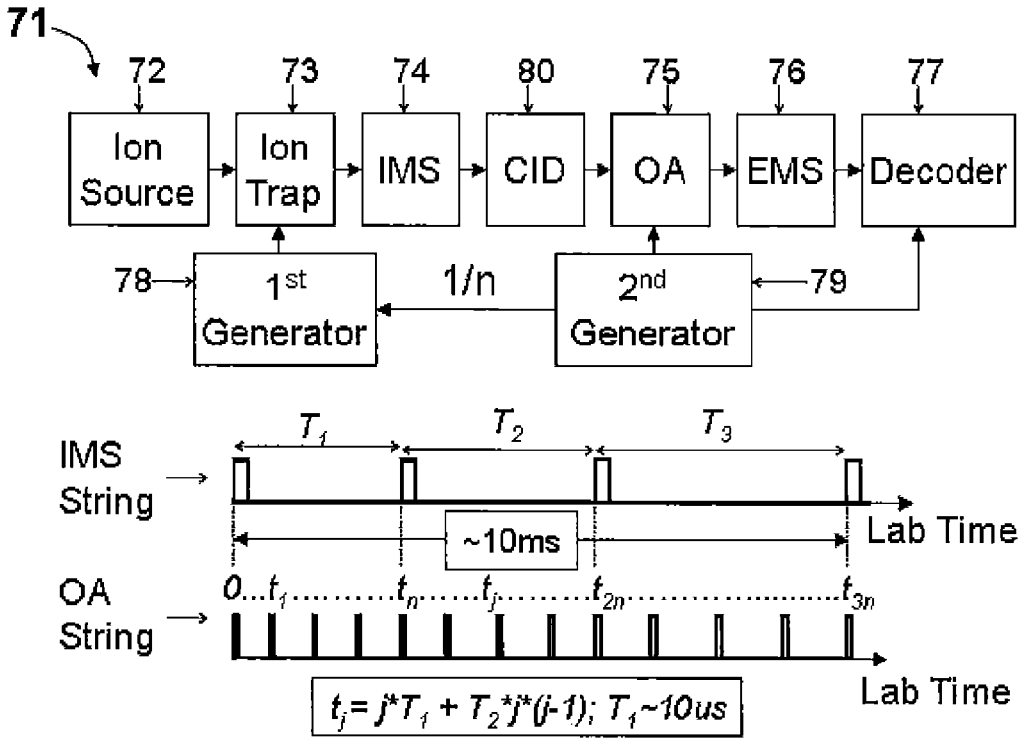
Figure 8:
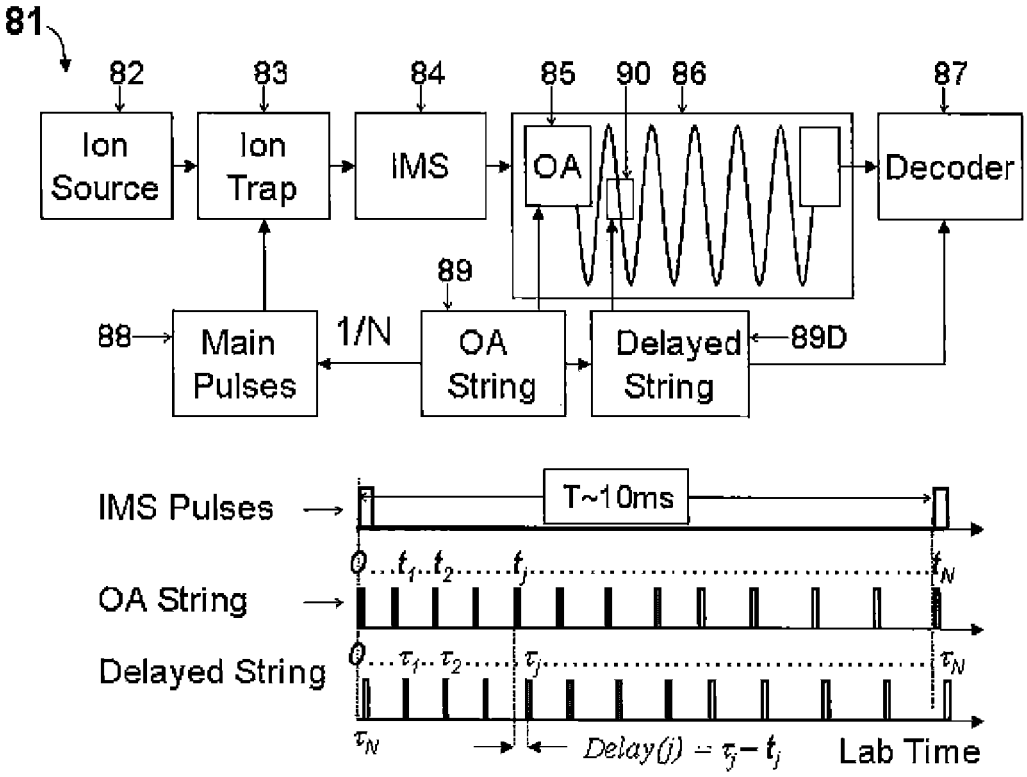
Figure 9:
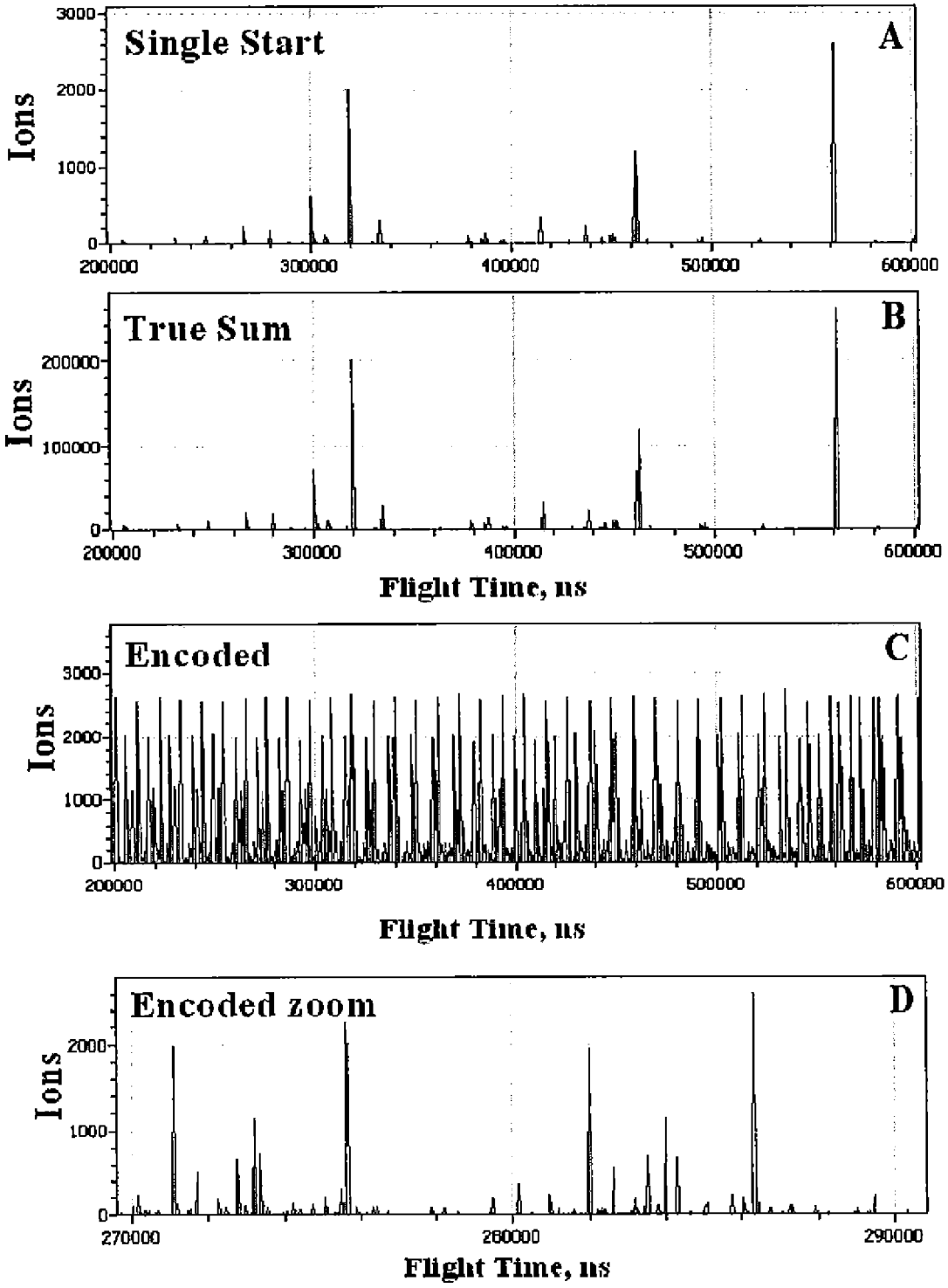
Figure 10:
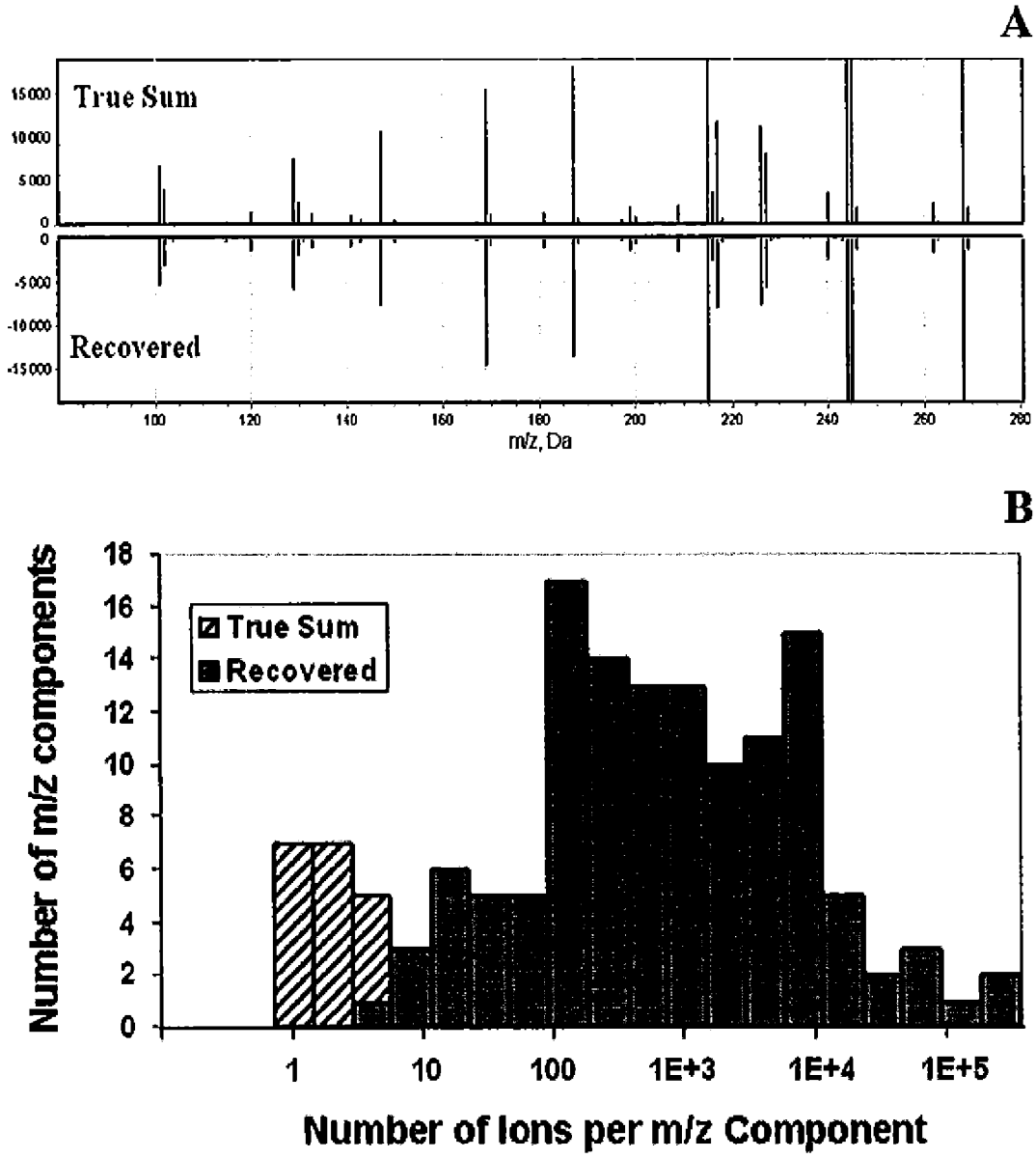
Figure 11:
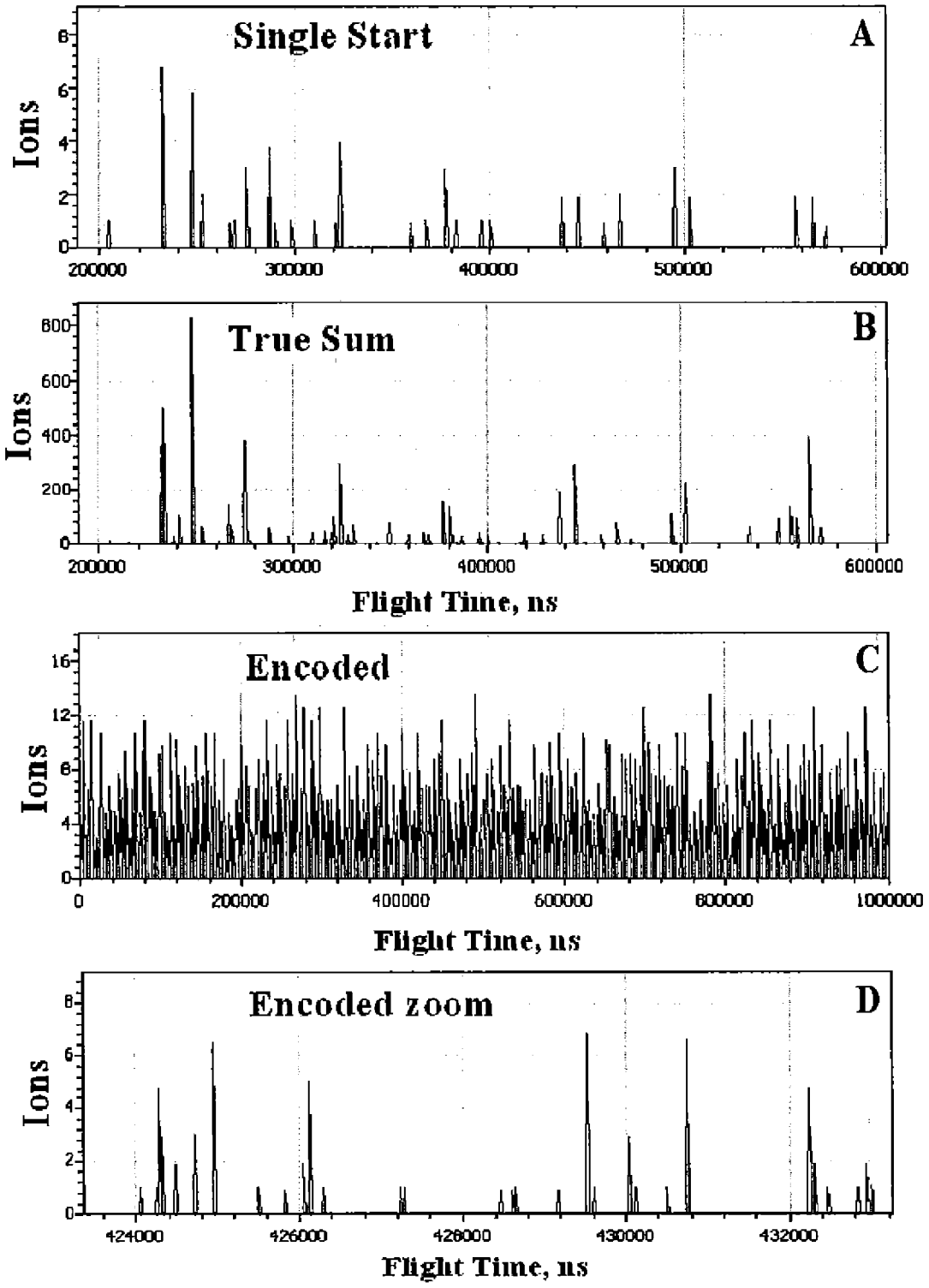
Figure 12:
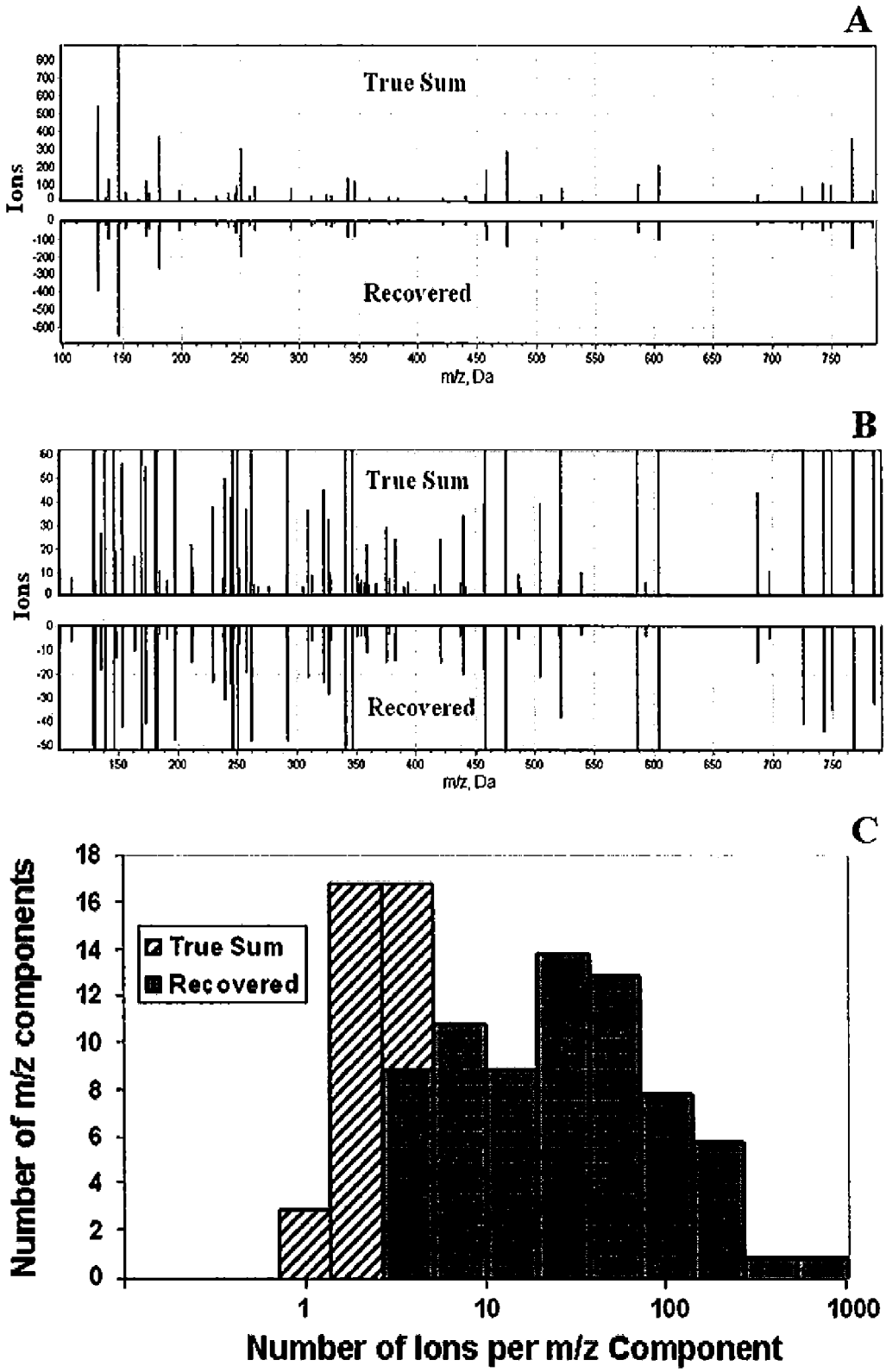

FIG. 4 presents the preferred embodiment of electrostatic analyzer of the invention;

FIG. 5 presents a diagram with main steps of the preferred method of the invention;

FIG. 6 presents a diagram of the preferred decoding algorithm of the invention;

FIG. 7 shows a schematic of EMS tandem with ion-mobility spectrometer (IMS) and a timing diagram for IMS encoding;

FIG. 8 shows a schematic of EMS tandem with ion-mobility spectrometer (IMS) and a timing diagram for correlated m/z-mobility ion filtering;

FIG. 9 illustrates algorithm testing and presents spectra corresponding to different stages of spectra encoding and decoding in case of strong signals;

FIG. 10 presents results of mass spectra recovery within 5.5 orders of dynamic range;

FIG. 11 illustrates algorithm testing and presents spectra corresponding to different stages of spectra encoding and decoding in case of weak MS-MS signals;

FIG. 12 illustrates algorithm testing and presents results of mass spectra recovery.

DETAILED DESCRIPTION

Prior Art

Figure 1:
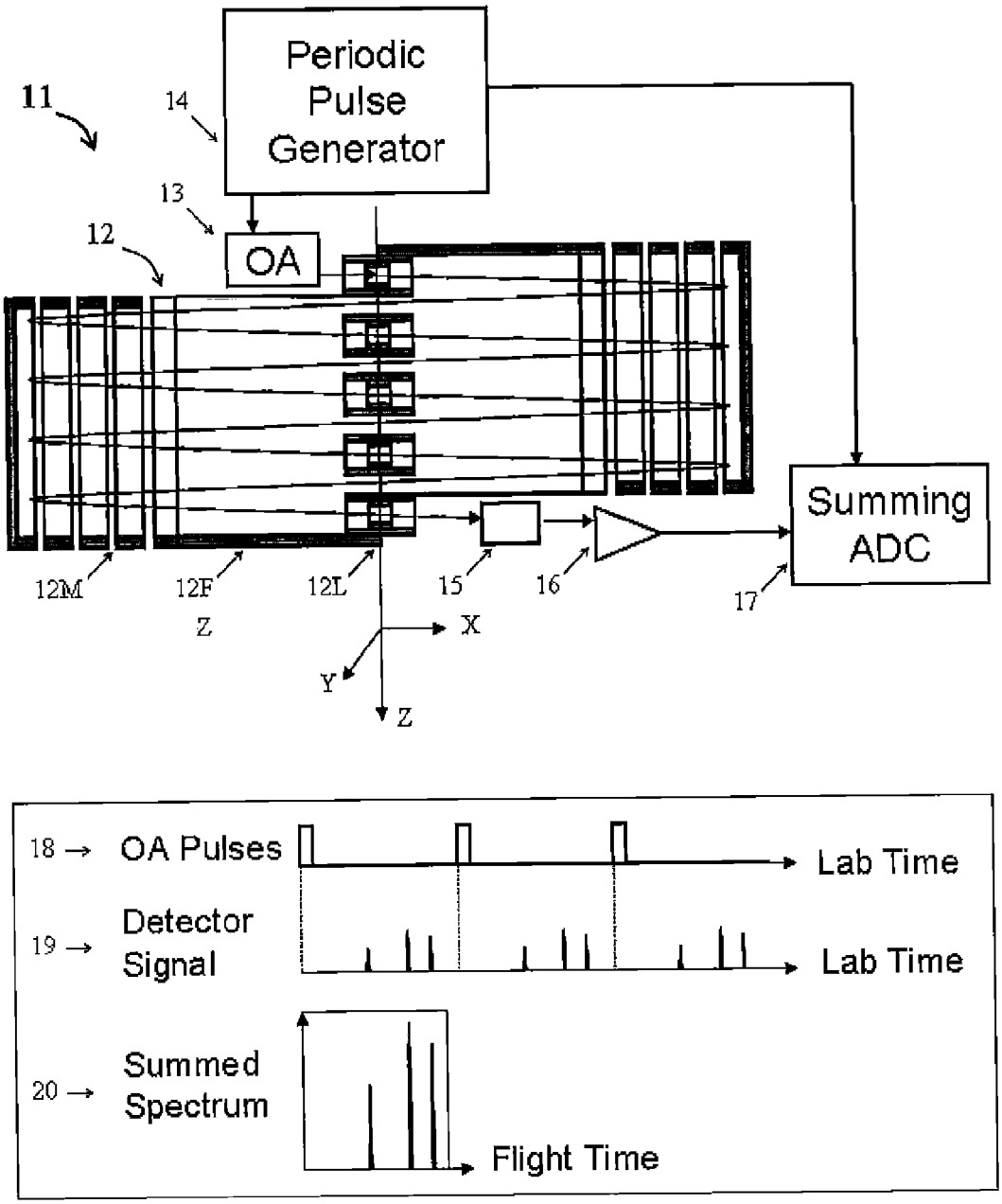
FIG. 1 depicts a block-schematic and synchronization schematics of the prior art multi-reflecting M-TOF with periodic and rear pulses in the orthogonal accelerator.

Referring to FIG. 1, the prior art MR-TOF mass spectrometer with an extended flight path 11 comprises an MR-TOF analyzer 12 with ion mirrors 12M, an orthogonal accelerator OA 13, a TOF detector 15 with preamplifier 16, and main generator of periodic pulses 14, triggering both—accelerator 13 and Analog-to-Digital Converter (ADC) 17, optionally having on board spectra summation.

In operation, a continuous ion beam (shown by the white arrow) enters the orthogonal accelerator 13 along the Z-axis. Periodically, slices of the ion beam are pulsed accelerated along the X-direction and thus formed ion packets get into the M-TOF analyzer 12. After multiple reflections in MR-TOF the ion packets hit the detector 15, usually MCP or SEM. The detector signal is amplified by the fast amplifier 16 and gets recorded by the ADC 17. The signal is summed for multiple main starts. Normally, the ADC is operated in a well known 'analog counting' mode, wherein the amplitude of single ion is set to at least several ADC bits (typically 5-8 bits), and the ADC noise and physical noise are eliminated by 1-2 bit threshold. At low signal intensity the signal is acquired by TDC. The OA pulses are applied periodically every 0.5-1 ms (18). The pulse period is chosen somewhat larger than the flight time of the heaviest m/z component in order to allow all ions to clear the analyzer between starts (19). The repetitive signal is summed for multiple start pulses (20). Rare pulsing of the OA limits the duty cycle under 1% for M-TOF with long paths.

The sensitivity and the dynamic range of TOF MS may potentially be improved if using shorter start period than the flight time of the heaviest mass component. However, prior art does not propose an efficient encoding-decoding strategy.

In U.S. Pat. No. 6,861,645 and WO2008087389, incorporated herein by reference, the frequent pulses are applied periodically, and short spectra are recorded which causes large number of peak overlaps. Both methods may work only for low-populated spectra and for intense peaks. In U.S. Pat. No. 6,900,431, incorporated herein by reference, the Hadamard Transformation (HT) induces bogus peaks in the resultant recovered spectra due to signal variations between starts. In co-pending application PCT/IB2010/056136, incorporated herein by reference, fast pulsing in open E-trap employs a constant time intervals between the pulses, which affects the decoding.

Preferred Method

To increase sensitivity, speed, dynamic range, and space charge throughput of electrostatic mass spectrometers (open E-trap and M-TOF) the preferred method of the invention comprises the following steps: (a) frequent pulsing of a pulsed source; (b) signal encoding with pulse strings having uneven intervals; (c) passing ion packets through an electrostatic analyzer in a Z-directions such that said packets isochronously oscillate in an orthogonal X-direction; (d) acquiring long spectra corresponding to string duration; and (e) subsequent spectra decoding using the information on predetermined uneven pulse intervals.

Preferred Embodiment

Figure 2:
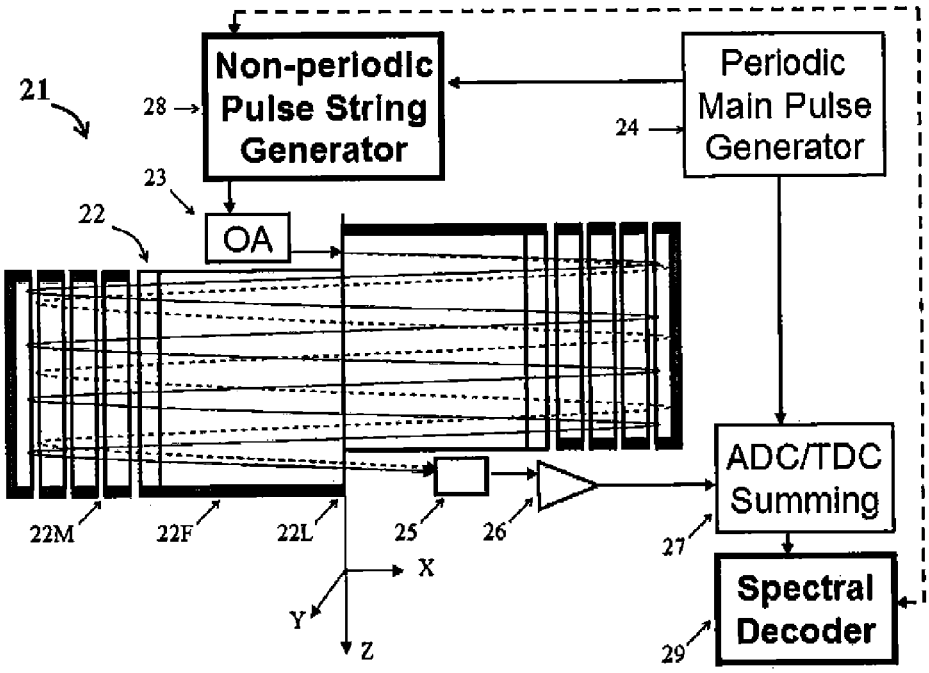
FIG. 2 shows a block-schematic and synchronization schematics of the electrostatic mass spectrometer (EMS) of the present invention.

Referring to FIG. 2, the preferred embodiment of mass spectrometer 21 of the invention comprises: an electrostatic mass spectrometer (here shown as a planar open M-TOF or E-trap analyzer) 22, an orthogonal accelerator 23, a main pulse generator 24, a fast response detector 25 with preamplifier 26, an ADC 27 with spectra summation, a spectral decoder 29 and a generator 28 of string start pulses with uneven intervals between start pulses. Said main generator 24 triggers both—ADC acquisition and said string generator 28, while the decoder 29 accounts the information on the time periods between start pulses in the string. The string generator triggers 28 the OA 23.

Figure 3:
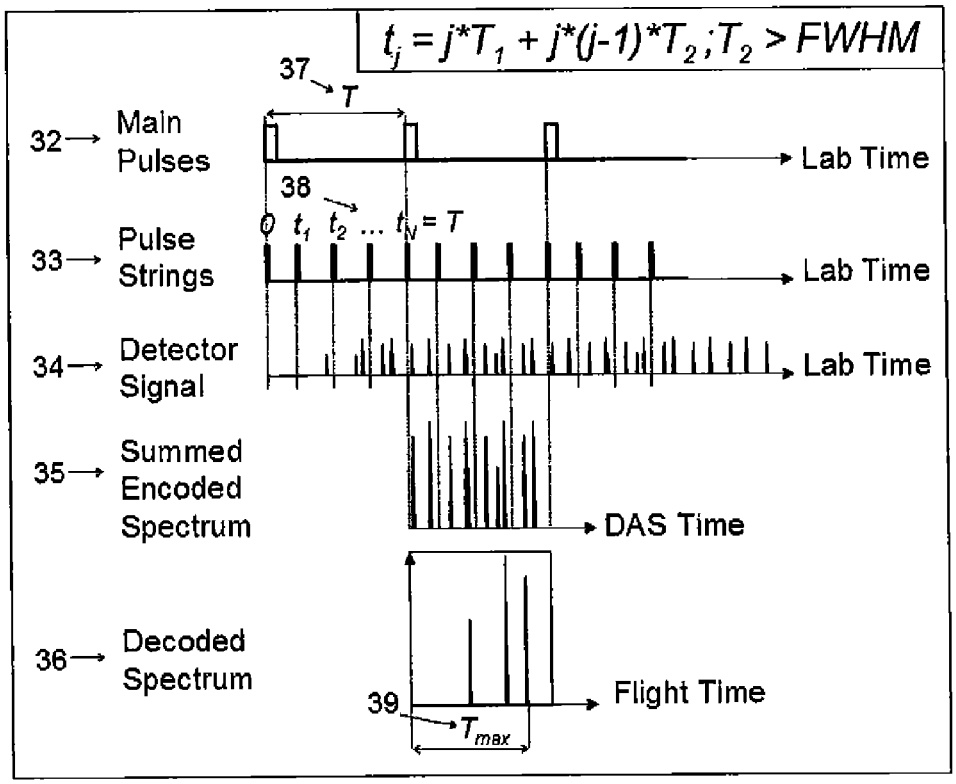
FIG. 3 shows timing diagrams and presents the examples of encoding pulse string.

Referring to FIG. 3, the operation of the EMS 21 is illustrated by a set of timing diagrams 32-34 plotted in the laboratory time starting with the very first pulse of the generator 24, and diagrams 35-36 plotted in DAS time starting with every pulse of the generator 24. In panels 34-36 there are considered only three model m/z species and a case of M-TOF electrostatic analyzer ($\Delta M=1$). The panel 32 shows triggers of the main generator with the period T (37). The panel 33 shows timing of the string generator starts at times 0, $t_1, t_2 \ldots, t_N=T$. Time of the pulse with number j is chosen to form non equal time intervals between string pulses. An example of such timing is shown as $t_i=i*T_1+T_2*i*(i-1)$. The panel 34 shows the ion signal on the detector 25. The panel 35 shows the ADC signal summated for the period between pulses of the main generator 24. The panel 36 shows the decoded spectrum which looks as TOF spectrum at S=1, but acquired with much higher duty cycle of the OA.

It is of principle importance that the uneven start sequence eliminates the systematic peak overlapping for any particular pair of m/z components. Occasional overlaps are likely to occur, but would not repeat for other start pulses. Those occasional overlaps are likely to be distinguished from systematic peak series and are expected to be either accounted or discarded at the spectral decoding stage. It is also of principal importance, that the non periodic pulse sequence eliminates a possible confusion between series of peaks, since the non periodicity allows unequivocal assignment between start pulses and corresponding peaks. The coding and decoding issue is the central topic of the present invention.

The non-periodicity can be slight but sufficient to arrange a unique time intervals between each pair of start pulses. The number of signal peaks per single m/z component is approximately $N=S*\Delta M$, wherein S is the number of start pulses in the string and $\Delta M$ is the number of peaks within multiplets in an open E-trap. The encoded spectrum is N times more populated compared to regular TOF spectrum, so the decoding depends on details of the coding-decoding algorithms described below.

The key feature of the invention is the non repetitive time intervals between fast pulses, i.e. interval between any pair of start pulses is unique and differs by at least one peak width: $||t_i-t_j|-|t_k-t_l||>\Delta T*C$ for any i, j, k and l, where $\Delta T$—is peak width, C is coefficient, C>1. One example of a sequence with unique intervals is: $T_i=j*T_1+T_2*j*(j-1)$, wherein time $T_1$ is about T/N, $T_2<<T_1$ and $T_2>\Delta T*C$; C>1

For E-trap and M-TOF with 1 ms flight time and for 3-5 ns narrow peaks the preferable value of $T_1$ is from 1 to 100 us and the preferable value of $T_2$ is from 5 to 100 ns. Values of $T_1$ and $T_2$ could be optimized based on the maximal reasonable number of pulses N in the string based on the spectral population. Another example is: $T_i=i*T_1+T_2*j*(j-1)$, wherein index j is varied from 0 to N such that to smooth the course of interval variations. One may use multiple other sequences with non equal pulse intervals while still decoding with sharp resonance for correct hypotheses.

Field Structure of EMS:

The electrostatic mass analyzers may employ various field structures as long as they allow ion passage through the analyzer in the Z-direction and isochronous ion oscillations in the orthogonal plane. The examples comprises (i) an analyzer built of two electrostatic ion mirrors for ion repulsion in the X-direction; (ii) a multi-turn analyzer built at least two electrostatic deflecting sectors for closing of central trajectory into a loop in the XY-plane; and (iii) a hybrid analyzer built of at least one electrostatic sector and at least one ion mirror for arranging curved ion trajectories with end reflections in the XY-plane. Optionally, said Z axis is generally curved, and wherein a curvature plain is generally at an arbitrary angle to a plane of said central ion trajectory. Ion trajectories within said electrostatic analyzer may have an arbitrary curved jigsaw shape or may an arbitrary spiral shape with the spiral projection having one letter shape of the group: (i) O; (ii) C; (iii) S; (iv) X; (v) V; (vi) W; (vii) UU; (viii) VV; (ix)Ω; (x) γ; and (xi) 8-figure trajectory shape.

Analyzer type: The same type of electrostatic field structure may be employed for both—open E-trap and M-TOF, which depends on the ion source and ion trajectory arrangements. In one group of embodiments, said electrostatic analyzer is an open electrostatic trap arranged by injecting ion packets into said analyzer at an angle to the X-axis such that an ion path between said pulsed ion source and said detector is equal to an integer number of oscillations M within a span $\Delta M$; and wherein said spread $\Delta M$ in number of oscillations is one of the group: (i) 1; (ii) from 2 to 3; (iii) from 3 to 10; (iv) from 10 to 30; and (v) from 30 to 100. Preferably, said number of oscillations M is one of the group: (i) 1; (ii) under 3; (iii) under 10; (iv) under 30; (v) under 100; and (vi) above 100. Preferably, the number of pulses S in said string of start pulses is adjusted depending on the spread in the number of oscillations $\Delta M$, such that the total number of peaks in the coded raw spectrum being a product of $\Delta M*S$ is one of the group: (i) from 3 to 10; (ii) from 10 to 30; and (iii) from 30 to 100.

Preferably, said electrostatic field of said E-trap analyzer is adjusted to provide ion packet time focusing at a detector plane $X=X_D$ for every ion cycle.

In another group of embodiments, said electrostatic analyzer comprises one multi-pass time-of-flight (M-TOF) mass analyzer of the group: (i) MR-TOF analyzer with a jigsaw flight path; (ii) a MT-TOF analyzer with a spiral flight path; and (iii) an orbital TOF analyzer. Preferably, said M-TOF comprises one mean of spatial focusing in the Z-direction of the group: (i) a set of periodic lens in the field free region; (ii) spatially modulated ion mirrors; and (iii) at least one auxiliary electrode for spatial modulation of ion mirror electrostatic field. Alternatively, the angular divergence in the Z-direction is limited by either a set of periodic lenses or a set of periodic slits (>2 slits).

The co-pending patent applications 'Electrostatic trap' describes multiple analyzers with two-dimensional electrostatic fields of either of planar symmetry, wherein E-trap electrodes are parallel and are linearly extended in Z-direction, or of cylindrical symmetry, wherein E-trap electrodes are circular and the toroidal field volume extends along the circular Z-axis.

Referring to FIG. 4, the most preferred EMS is toroidal electrostatic analyzer 41 comprises two parallel and coaxial ion mirrors 42 separated by a field-free space 43. The analyzer can be used in two regimes—open E-trap and M-TOF which depends on the ion packet Z-size, ion inclination angle $\alpha$ to the X-axis and angular ion spread $\Delta\alpha$. In M-TOF mode, said analyzer comprises either a set of periodic lenses or a periodic slit (both denoted 44) for limiting ion packet spread in the Z-direction. Each mirror 42 comprises two coaxial sets of electrodes 42A and 42B. Preferably, each electrode set 42A and 42B comprise at least three ring electrodes with distinct potentials forming an accelerating lens 45 at the mirror entrance such that to allow a time-of-flight focusing to at least third-order relative to energy spread and to at least second-order relative to small deviations in spatial, angular, and energy spreads of ion packets, including cross terms. Further preferably, at least one of electrode sets 42A or 42B comprises an additional ring electrode 46 for radial ion deflection. Compared to planar analyzers of prior art, the toroidal analyzer 41 extends the circular Z-direction at compact analyzer packaging. To avoid additional aberrations related to toroidal geometry, the radius $R_C$ of toroidal field volume should be larger than one sixth of the cap-to-cap distance L and the ion inclination angle $\alpha$ to the X-axis should be less than 3 degrees to provide aberration limit of resolution above 100,000. The icon 47 illustrates ion optical simulations of the toroidal analyzer coupled with an orthogonal accelerator OA 48. To provide space for the OA, the OA is tilted at the angle $\gamma$ to Z axis, and an additional steering plate 49 steers the beam for angle $\gamma$ after single ion reflection.

Pulsed Sources:

The invention is applicable to variety of intrinsically pulsed ion sources like MALDI, DE MALDI, SIMS, LD, or EI with pulsed extraction. In one particular embodiment, a DE MALDI source is employed with a 1-10 kHz repetition rate Nd:YAG laser to accelerate sample profiling. This does not prohibit extending flight path to about 40-50 m and the flight time of 100 kDa ions to 10 ms for improving resolving power of the analysis. Similarly, in SIMS pulsed sources, primary ionization pulses could be applied at about 100 kHz rate (10 us period), while flight time in the analyzer takes about 1 ms. Even faster pulsing could be used for surface or depth profiling applications. In EI accumulating source, a faster extraction pulsing improves the dynamic range of the analysis by reducing the electron beam saturation. The novel encoding-decoding method allows using longer flight time and thus improves resolution without limiting pulsing frequency and hence the speed and the sensitivity.

Pulsed Converters:

Various continuous or quasi-continuous sources could be employed if using a pulsed converter like an orthogonal pulsed accelerator or a radio frequency trap with ion accumulation and pulsed ejection. The group of orthogonal accelerators (OA) unites such converters as: a pair of pulsed electrodes with a grid covered window in one of them, a grid-free OA using plates with slits, an RF ion guide with pulsed orthogonal extraction, and an electrostatic ion guide with pulsed orthogonal extraction. To improve duty cycle of OA, the open E-trap allows using an extended OA—longer than ion packet displacement $Z_1$ per ion cycle in the E-trap.

Accumulating Ion Guides:

Preferably, any pulsed converter further comprises an upstream gaseous RF ion guide (RFG) such as an RF ion multipole, an RF ion channel; and an RF array of ion multipoles or ion channels. Preferably, said gaseous RF ion guide comprises means for ion accumulation and pulsed extraction of an ion bunch, and wherein said extraction is synchronized to OA pulses. Further preferably, the duration of start pulse string is chosen comparable to the spread in ion arrival time into said OA. Further preferably, the period of said main generator is longer than the flight time of the heaviest m/z in the spectrum to avoid spectral 'overtake'. The arrangement allows improving the OA overall duty cycle. To reduce detector saturation, the RFG accumulating mode is interleaved with RFG pass through mode.

Ion Packet Steering:

Accounting small (1-3 degrees) inclination angle $\alpha$ of ion trajectory in the EMS analyzer, special measures should be taken (a) to arrange the inclination angle without tilting ion time front; and (b) to avoid spatial interference of ion source or converter with the returning ion packets. In one method, said ion source or converter are displaced from the X-Z symmetry axis of the analyzer, and the ion packets are returned onto said X-Z symmetry axis by at least one pulsed deflector. In another method, the parallel emitting source (like MALDI, SIMS, ion trap with radial ejection) is tilted at the angle $\alpha/2$ and then ion packets are steered forward at the angle $\alpha/2$ to arrange ion inclination angle $\alpha$ to the axis X.

Again referring to FIG. 4, another method is suited for OA pulsed converters 48 which emit ions at the inclination angle $90-\beta$ relative to the incoming continuous ion beam. The angle $\beta$ is defined by acceleration voltages in a continuous ion beam $U_z$ and at pulsed acceleration $U_x$: $\beta=(U_z/U_x)^{1/2}$. In this method, the OA 48 is reverse tilted at the angle $\gamma$ (relative to Z axis) and then after at least one ion reflection within the analyzer the ion packets are reverse steered at the angle $\gamma$, wherein the angle $\gamma=(\beta-\alpha)/2$. The tilt and steering mutually compensate rotation of the time front. A larger ion displacement of the OA provides more room for OA.

Divergence of Ion Packets:

For ion sources with large angular divergence it is preferable using open E-trap analyzers. However, our own analysis of multiple practical pulsed sources and converters indicates that the ion packets could be formed with low divergence under 1 mrad which allows using M-TOF analyzers. For multiple ion sources the estimated emittance in two transverse directions is $\Phi<1\ mm^2*eV$:

For DE MALDI source $\Phi<1$ mm$^2$*eV for M/z<100 kDa at <200 m/s radial velocity;

For OA converter past RF guide: $\Phi<0.1$ mm$^2$ eV at thermal ion energy;

For pulsed RF trap: $\Phi<0.01$ mm$^2$*eV for M/z<2 kDa at thermal ion energy;

The surprisingly small emittance appears due to small transverse size of initially formed ion packets under 0.1 mm. In case of radial symmetric ion sources the maximal emittance of 1 mm$^2$*eV can be converted into an angular-spatial divergence smaller than D<20 mm*mrad by accelerating ion packets to 10 keV energy. Such divergence can be properly reformed by lens system to less than 2 mm*10 mrad divergence in the ZY-plane tolerated by ion mirrors and to less than 20 mm*1 mrad in the XZ-plane which could be transferred through the MR-TOF electrostatic analyzer without ion losses and without additional refocusing in the Z-direction.

Optimal Pulse String:

The number S of pulses in the string may be optimized to recover the duty cycle (DC) of pulsed converters, while keeping the overall population of multi-start spectra under 20-30% for effective spectral decoding. As an example, for M-TOF with 1% DC per start, the number of starts may be brought to S=50 to reach maximal possible DC~50% limited by dead space in the OA. In case of open E-traps with 5-fold extended OA, the DC improves to 5%, while the number of multiplets grows to $\Delta M=5$. Then optimal number of starts is S=10. In case of using ion accumulation within a radiofrequency guide, the pulse string should be compressed in time to match time duration of ion packets within the OA. In all cases, the sensitivity gain=$\Delta M$*S. On the other hand, the number of peaks N in the spectrum is also equal to the same product N=$\Delta M$*S. Similarly the dynamic range of the detector is improved proportional to N. Thus, for both M-TOF and open E-trap, the number of peaks N is chosen to maximize the DC while keeping the spectrum population under 20% for effective spectral decoding.

In case of LC-MS the spectral population of main peaks is expected being <1%. However, the recovery of small peaks will be limited by chemical background having spectral population of about 30-70%. The chemical background may be reduced by such methods as: ion molecular chemical reactions or prolonged and mild ion heating in the ion transfer interface for removing organic cluster ions, a differential ion mobility separation, a dual step mass separation with intermediate soft fragmentation, a suppression of singly charged ions by detector threshold, suppression of singly charged ions by weak barrier at the exit of RFQ ion guide, etc.

Tandems:

Spectral population may be also reduced when using an additional step of sample separation of the group: a chromatographic or dual chromatographic separation; ion mobility or differential ion mobility separation; or a mass spectrometry separation of ions, e.g. in quadrupole filter, linear ion trap, an ion trap with mass dependent sequential release, or an ion trap with a time-of-flight mass separator. For MS-MS purposes ion separators are followed by an ion fragmentation cell.

Referring to FIG. 7, the tandem mass spectrometer 71 comprises an ion source 72, an ion trap 73 being triggered by a first encoding pulse generator 78, an ion mobility spectrometer (IMS) 74 as an exemplar ion separator, an OA 75 being triggered by a second encoded pulse generator 79, an EMS analyzer 76, and a spectral decoder 77. In operation, both pulse string generators 78 and 79 are synchronized, e.g. first generator 78 may be triggered at every $n^{th}$ start of the second generator 79, having time string like $T_j=j*T_1+T_2*j*(j-1)$ to ensure uneven time intervals in both triggering strings. The IMS string from generator 78 triggers ion injection from ion trap 73 into IMS 74. The duration of the string may be about 10 ms to match IMS separation time, and intervals between pulses may be about 1 ms to improve space charge throughput of the IMS. After IMS separation there are formed ion bunches with 100-200 us duration. Ions are introduced into the OA 75 which is triggered by the OA pulse string from second generator 79 with uneven time intervals of about 10 us. The signal is acquired at the EMS detector for the entire IMS cycle and is summed for multiple IMS cycles. As a result, each ionic component would be presented by approximately 10 IMS peaks and about 100 EMS peaks which improves dynamic range of the detector 100-fold compared to conventional IMS-TOFMS analyses.

Again referring to FIG. 7, the embodiment 71 may further comprise a fragmentation cell 80 between IMS 74 and OA 75. The fragmentation may employ prior art fragmentation methods like collision induced dissociation (CID), surface induced dissociation (SID), photo induced dissociation (PID), electron transfer dissociation (ETD), electron capture dissociation (ECD), and fragmentation by excited Ridberg atoms or ozone. The time diagram remains the same and the OA is operated with coded frequent pulsing (about 100 kHz) in order to track rapid changes of the ion flow after cell 80. Then the tandem 71 can provide all-mass pseudo MS-MS. In such combination the IMS is used for crude (resolution 50-100) but rapid separation of parent ions and the EMS is employed for even faster acquisition of fragment spectra. Optionally, in case of moderate ion flows, the encoding of the $1^{st}$ generator may be switched off. Preferably, the fragmentation cell (usually RF device) is equipped with means for ion accumulation and pulsed extraction and the OA pulse string is synchronized for the duration of the extracted ion bunch.

Referring to FIG. 8, another particular embodiment 81 of tandem mass spectrometer comprises an ion source 82, an ion trap 83 triggered by main pulse generator 88, an IMS 84, an OA 85 being triggered by a second encoded string generator 89, an M-TOF analyzer 86, a spectral decoder 87, and a time gate mass selector 90 in the M-TOF analyzer 86, said time gate selector is triggered by a delayed string 89D. In operation, the main pulse generator 88 has period T~10 ms matching IMS separation time. The OA string generator 89 forms a string of N pulses with uneven intervals and with the total duration of the main generator $T=t_N$. The delayed string 89D is synchronized with the OA string generator 88, but has a variable delay of number j pulse $\tau_j-t_j$ which is proportional to the time $t_j$. The time selection gate 90 (e.g. a pulsed set of bipolar wires) is located after one ion cycle in the M-TOF 86 and is capable of passing through ions in the particular range of flight times, proportional to ions $(m/z)^{1/2}$. As a result, the selected ion m/z range becomes correlated with the IMS separation time $t_j$ to separate a particular class of compounds, or a particular charge state this way reducing chemical noise.

Decoding Algorithms:

The population of the encoded spectra is the primary concern. In cases of LC-MS and GC-MS analyses we expect the population of encoded spectra from 1 to 10%, and in cases of IMS-MS and MS-MS the expected population is from 0.01 to 1%. Depending on the spectral population, the optimal peak multiplicity N varies from 10 s to 100 s, regardless of the origin of peak multiplicity—due to the multiplet formation or due to the frequent coded pulses.

Referring to FIG. 6, there is provided an algorithm for spectra decoding in an electrostatic mass spectrometry with fast coded pulsing and comprising the following steps: (a) encoding spectrum with fast uneven pulse string; (b) peak picking in the encoded spectrum; (b) gathering peaks into groups which are spaced in time according to start pulse sequence and or due to multiplet formation; (c) validating groups based on the number of peaks in the group and based on the integral characteristics of the encoded spectrum; (d) validating individual peaks based on correlation of peak characteristics within the group; (e) finding peak overlaps between groups and accounting or discarding of the overlaps; and (g) recovering spectra using non overlapping peaks to get decoded spectra.

The step of peak picking means finding peaks within the encoded spectrum, determining their time centroid, peak width, and integral. The peak information is gathered into a table, and subsequent steps operate with tabulated peak characteristics rather than with the raw spectra. The next step of gathering peaks into groups employs the known timing of start pulses and the predicted and calibrated multiplet formation, so the algorithm searches for peaks which are spaced accordingly. It is expected that some peaks may be missing in low intensity groups, or a limited portion of peaks could be affected by overlaps between groups. So for every peak the gathering algorithm tries several hypotheses of start number and number of peak within a multiplet. Actual implementation of the algorithm may employ principles of data bases and indexing for acceleration of the process. The peak gathering step is preferably accelerated by preliminary sorting of peaks into overlapping intensity ranges. The range span depends on the intensity, since at lower intensities there appear wider statistical spreads. Alternatively, the step of gathering groups employs a correlation algorithm.

The next step of group validation is applied to gathered groups likely corresponding to individual m/z species. The step is needed since a weak resonance with peaks taken from foreign groups may form a wrong hypothesis for a non existing principal m/z component. There should be set a threshold for a minimal number of peaks in the valid group in order to filter out the majority of groups formed by overlaps with foreign groups and also to remove groups formed from a random noise signal. Such criteria of minimal number of peaks in a valid group may be formed based on the integral characteristics of the encoded spectrum, such as population density measured for all signal intensities or within particular dynamic range span.

The step of validating individual peaks within the group is employed for earlier filtering out of false peaks originating from overlaps with other groups. By analyzing the group characteristics there may be used several criteria for earlier detection of false taken peak: such peak is likely to have distinct intensity (which may be also filtered out at an earlier step of gathering peaks within intensity ranges); such peak is likely to be wider or its centroid being displaced compared to the rest of peaks in the group. The filtering may employ principle of group correlation. The filtering of wrong taken peaks may be also assisted by earlier analysis of more intense peaks and their removal from the total peak table for subsequent analysis (earlier described strategy of working with descending intensity ranges). The filtering also may be iteratively repeated after completion of the process of determining principal components.

The algorithm can be accelerated by using parallel processing in multi-core boards like video-boards or multi-core PC. Such parallel processing can be applied e.g. to the step of group validation, or to the step of peak gathering into groups at descending intensity ranges (each processor analyses separate intensity range). Alternatively, the split between groups can be made based on crude spectra segmenting based on wide time intervals. As an example, one may notice that interval between the start pulses varies between 10 and 11 us, so the spectrum can be analyzed in 1 us intervals spaced by 10.5 us.

Criteria:

For group validation (prior to discarding overlaps or ultimately deconvolving the partial overlaps) there should be chosen criteria which should be based on the integral characteristics of the encoded spectrum. A criterion can be based on the observed spectral population density D and on the total number of ions in the recorded encoded spectrum (estimated from integral signal). Such criterion is then used to calculate the minimal required number of peaks in a group in order to consider the group being correct, or in other words to reasonably minimize the possibility of a wrong group which is collected of occasional overlaps only. The average number H of wrong hits in a group can be estimated as: H~P*N*W/T, or H~P*N/B where P—is the number of ion peaks in the recorded encoded spectrum, N—is the peak expected multiplicity, i.e. the product of peak number in multiplets ΔM and the number S of pulses in the string, i.e. N=ΔM*S, W—is the base width of strong peak, T—is spectrum length and B is the number of possible peak places within the spectrum length, i.e. B=T/W. However, there are statistical variations in actually occurring number of wrong hits per group, and to cut off the majority of wrong hypotheses (mind large number of tested groups) there should be estimated a statistical criterion threshold of minimal number C of peaks in a group to consider the group valid. A simple estimate is that in Poisson distribution with mean equal to H the probability of C hits is: $P(H,C)=H^C*\exp^{-H}/C!$ In a more careful calculation to have less than one wrong group picked there should be satisfied the following criterion:

$$B\cdot C_N^{\,C}\cdot C_{B-N}^{\,P-C}<C_B^{\,P}$$

Where $C_m^{\,n}$ is a binomial coefficient from a set of m elements by n elements.

The step of discarding peak overlaps may be implemented using data base approach or by accumulating pointers onto spectral peaks from various groups. Reliability of the algorithm improves by repeating a cycle: the validity of peak groups is revised after discarding overlaps and finding principle components. For better performance the algorithm may be cycled with decreasing intensity ranges of examined peaks. Decoding may be improved by a prior step of background subtraction or deconvolution of chromato-mass spectrometric data.

Algorithm for MS-MS:

The above described algorithm is primarily designed for analysis of encoded spectra with intense peaks. A time-effective approach may capitalize on the low number of ions in MS-MS spectra. According to the forth aspect of the invention, there is provided an algorithm for decoding of low intensity spectra in electrostatic analyzers (E-traps and M-TOF) using a time-coded fast pulsing. The decoding algorithm comprises the following steps: (a) summing signals spaced according to pulse sequence for every bin in the encoded spectrum; (b) rejecting sums which has number of non zero signals below a preset threshold; (c) peak detecting in the summed spectrum to form hypotheses of correct peaks; (d) extracting groups of signals corresponding to each hypothesis from the encoded spectrum; (e) logically analyzing and discarding signal overlaps between groups; (f) reconstructing correct spectra using non overlapping signals; and for E-trap case (g) further reconstructing spectra accounting peak distribution within multiplets.

The step (a) of summing signals may be implemented as a straight sweep, wherein for every time bin in the encoded spectrum there are summed signals with intervals corresponding to pulse intervals. Such summation should account signals spreading into the next pulse string, i.e. spectrum overtake in the summed spectrum. The sweep across 1 E+6 bins with 100 summations per each bin can be split into multiple threads for parallel processing. In one particular algorithm, the summing may be further accelerated by grouping into larger size bins equal to peaks' base width.

In typical MS-MS encoded spectrum, 1000 ions occupy only 0.1% of the time scale. The probability of single wrong hit within a group is <10% for 100 pulses in the string, i.e. an average number of wrong hits in the group is <0.1. Thus the direct summation is expected to provide first-cut identification of principle components (or group identification) without elaborate analysis of the overlaps. At this stage it is preferable to convert single ion signals into 1 bit signals, thus eliminating the additional noise due to detector response per single ion. Alternatively, the signal can be recorded by a TDC. Assuming less than 1 average hit per group, the probability of 8 false peaks in a group is less than 1 e−5 and accounting 1 e+5 possible peak positions there would appear less than 1 false group. The false group is likely to be removed at stages of group validation, peak validation or at accounting of group overlaps. Thus the algorithm can reliably detect species that have only 0.08 ions per start with total signal of about 8 ions per start string! This is the striking result: regardless of the coding and decoding the threshold for peak detection of the open E-trap approaches the sensitivity of conventional TOF (~5 ions per peak), while the EMS with the coded fast pulsing provides a much higher duty cycle of the pulsed converter and a much higher dynamic range of the detector. Both gains are ~N=ΔM*S.

Testing Algorithms:

In our tests the algorithm shown in FIG. 5 takes approximately 10 second per 1 ms spectrum. However, the processing time is expected to drop by 3-4 orders of magnitude by parallel processing on multi-core board such as NVIDIA TESLA M2070. As an example, each processor core may analyze individual summed encoded spectra, or time separated segments of spectra, or at least do parallel validation of separate peak groups. Then spectra decoding would no longer limit the acquisition speed for any foreseen applications, like fast MS-MS, surface profiling or IMS-MS.

Referring to FIG. 9, there are presented results of high resolution TOF spectra decoding with the above described algorithm on the example of MS-MS spectra with high peak intensity. The spectrum is generated based on sequence of peptides YEQTVFQ and LDVDRVLVM while assuming possibility of a, b, x and y fragments with total number of fragments equal to 152. Intensity of principle fragments spectrum is distributed randomly within 5.5 orders of magnitude varying from 0.01 to 3000 ions per peak per start (accumulated over multiple strings). The signal per every start pulse is generated statistically while assuming Gaussian peak shape with FWHM=3 ns. A sequence of uneven 100 pulses is applied for encoding the spectrum with $T_j=j*T_1+j*(j-1)T_2$ wherein $T_1$=10 us and $T_2$=5 ns. A decoding algorithm is employed without using any knowledge of the original spectrum but with the knowledge of time intervals between starts. Panel A represents one of statistically generated spectrum per single start pulse. Vertical scale corresponds to peak height in number of ions. Such spectrum would correspond to prior art M-TOF with rear pulses. Panel B shows truly summed 100 individual spectra without encoding. Such spectrum can be obtained in conventional M-TOF at longer acquisition. Panel C shows the spectrum encoded by a string with 100 unevenly distributed pulses. The overall population of the time scale is 3% only. Panel D shows a horizontal zoom of the encoded spectrum to provide a visual impression of the spectrum population. For decoding of the spectrum we employed the algorithm of FIG. 5, though applied in two stages. At first stage, the peak detection has been done with the ion threshold of 3 ions. For group validity we required presence of more than 30 peaks in the group. At this stage the algorithm detected 110 mass components. Then the corresponding peaks were removed from the encoded spectrum. At the second stage, the threshold has been set to 0.5 ions and the criterion of group validity has been set to 5 peaks in the group. The second stage allowed detection of another 24 mass components. The algorithm did not pick up 18 mass components in the range under 0.05 ion per start.

Referring to FIG. 10-A, the results of decoding are presented by two symmetrically positioned spectra: the top spectrum corresponds to true summation (as if the M-TOF is acquiring spectra for 100 times longer) and the bottom spectrum corresponds to the encoded/decoded spectrum. All the intensive mass components are recovered, though with a moderate loss in intensity, since the algorithm did not compensation intensity of removed overlapping peaks. Referring to FIG. 10-B, there is shown a histogram presenting a number of ions within each range of intensity. The dark part of the histogram corresponds to recovered true peaks and the dashed part of the histogram corresponds to non recovered peaks which are present in the true summed spectrum. The peaks are distributed within 5.5 orders of magnitude (mind logarithmic horizontal axis). The distribution remains unchanged at intense side (from 5 to 1 E+6 ions), while some peaks are lost at low intensity side-below 5 ions per cycle of 100 pulses. This corresponds to a reliable detection of signals with 0.05 ion/start. Thus, the invention provides approximately 100-fold gain in sensitivity compared to conventional M-TOF having duty cycle of the orthogonal accelerator under 1%. The algorithm allows reliable decoding of spectra at least within 5 orders of dynamic range in case of intensive signals. In case of LC-MS analysis the dynamic range is likely to be limited by chemical noise from the solvent and of ion source materials. Nevertheless, the method of the invention would enhance the speed of data acquisition which is important for tandem configurations, like LC-IMS-MS LC-FAIMS-MS, or MS-MS, or at sample profiling.

Referring to FIG. 11, there are presented results of E-TOF (ΔM=1) spectra decoding on the example of MS-MS spectra with low peak intensity from 0.01 ion/start to 10 ions/start. The spectrum is generated based on the sequence of peptide YEQTVFQ with total number of fragments equal to 100. Intensity of fragments is distributed randomly within 3 orders of magnitude. A sequence of uneven 100 pulses is applied for encoding the spectrum. Similarly to previous test, panel A represents an exemplar statistically generated spectrum per single start pulse, panel B shows truly summed 100 individual spectra without encoding, panel C shows the spectrum encoded by a string with 100 unevenly distributed pulses and having 1.25% overall population of the time scale; and panel D shows zoom of the encoded spectrum to provide a visual impression of the spectrum population. For spectral decoding we applied the same one-step algorithm of FIG. 5, wherein for group validity we required only presence of more than 3 peaks in the group.

Referring to FIG. 12-A, the results of decoding are presented by two symmetrically positioned spectra: the top one corresponds to true summation (as if the M-TOF is acquiring spectra for 100 times longer) and the bottom spectrum corresponds to the encoded/decoded spectrum. The FIG. 12-B provide zoom of the vertical scale to show some differences appearing for low intensity peaks. In FIG. 12-C shows a histogram of signals recovery, wherein logarithmic horizontal scale represents peak intensity ranges roughly correspond to factor of 2. The dark part of the histogram corresponds to recovered true peaks and the dashed part of the histogram corresponds to non recovered peaks which are present in the true summed spectrum. The distribution remains unchanged at intense side (5 to 1000 ions), while about half of peaks are lost in the intensity range from 3 to 5 ions.

The tested algorithm is the simplified version of the disclosed algorithm. In those tests we did not apply peak ranging, omitted peak analysis within groups, did not account difference in dynamic ranges of overlapping peaks, did not make any attempt of recovering partially overlapping though resolvable peaks, etc. On the other hand, the tests have not been accounting realistic chemical noise typical for LC-MS data and did not account variations of detector response per single ion. Still, the tests confirmed the feasibility of the method and proved that sparse spectra can be formed in high resolution spectra even at presence of 1 e+4 of encoded peaks.

Although the present invention has been describing with reference to preferred embodiments, it will be apparent to those skilled in the art that various modifications in form and detail may be made without departing from the scope of the present invention as set forth in the accompanying claims.

What is claimed is:

1. An electrostatic mass spectrometer comprising:

(a) a pulsed ion source for ion packet formation;

(b) an ion detector;

(c) a multi-pass electrostatic mass analyzer providing an ion packet passage though said analyzer in a Z-direction and isochronous ion oscillations in the locally orthogonal direction X;

(d) a pulse string generator for triggering said pulsed ion source or pulsed converter with time intervals between any pair of start pulses being unique within the peak time width AT on the detector;

(e) a data acquisition system recording of detector signal at the duration of said pulse string and for summing spectra corresponding to multiple pulse strings;

(f) a main pulse generator for triggering both—said data acquisition system and said pulse string generator; and (g) a spectral decoder for reconstructing mass spectra based on the detector signal and on the information on the preset time intervals of said start pulses.

2. An apparatus as set forth in claim 1, wherein within the pulse string, for any non-equal numbers of start pulses i and j, the start times $T_i$, and $T_j$ satisfy one condition of the group: (i) $|(T_{i+1}-T_i)-(T_{j+1}-T_j)|>\Delta T$; (ii) $T_j=j*(T_1+T_2*j*(j-1))$, wherein 1 us$<T_1<$100 us and 5 ns$<T_2<$1000 ns.

3. An apparatus as set forth in claim 1, wherein the electrodes of said electrostatic analyzer are parallel and are linearly extended in Z-direction to thereby provide a two-dimensional electrostatic filed of planar symmetry.

4. An apparatus as set forth in claim 1, wherein said electrostatic analyzer comprises parallel and coaxial ring electrodes to thereby provide a toroidal volume with a two-dimensional electrostatic filed of cylindrical symmetry.

5. An apparatus as in claim 4, wherein the mean radius of said toroidal volume is larger than one sixth of ion path per single oscillation and wherein said analyzer has at least one ring electrode for radial ion deflection.

6. An apparatus as set forth in claim 1, wherein said electrostatic analyzer comprises one set of electrodes selected from the group consisting of: (i) at least two electrostatic ion mirrors spaced by field-free region; (ii) at least two electrostatic sectors; and (iii) at least one ion mirror and at least one electrostatic sector.

7. An apparatus as set forth in claim 6, wherein said electrostatic analyzer is an open ion trap with a non fixed ion path and wherein the number of ion oscillations M in said analyzer has one span ΔM of the group: (i) from 2 to 3; (ii) from 3 to 10; (iii) from 10 to 30; and (iv) from 30 to 100.

8. An apparatus as set forth in claim 7, wherein said electrostatic analyzer comprises a multi-pass time-of-flight mass analyzer with a fixed flight path which and one means for limiting ion divergence in the Z-direction of the group: (i) a set of periodic lens; (ii) electrostatic mirrors modulated in the Z-direction; (iii) electrostatic sector modulated in the Z-direction; and (iv) at least two slits.

9. An apparatus as set forth in claim 8, wherein said pulsed source comprises one orthogonal pulsed converter selected from the group consisting of: (i) an orthogonal pulsed accelerator; (i) a grid-free orthogonal pulsed accelerator; (iii) a radiofrequency ion guide with pulsed orthogonal extraction; (iv) an electrostatic ion guide with pulsed orthogonal extraction; and (v) any of the above accelerators preceded by an upstream accumulating radio-frequency ion guide.

10. An apparatus as in claim 9, wherein said converter is tilted relative to Z axis and an additional deflector steers ion packets at the same angle after at least one ion reflection or turn within said electrostatic analyzer.

11. A method of mass spectral analysis comprising:

(a) frequent pulsing of a pulsed source with a pulse string generator;

(b) signal encoding with pulse strings having uneven intervals;

(c) generating a pulse with a main pulse generator to trigger (i) a data acquisition system and (ii) said pulse string generator;

(d) passing ion packets through an electrostatic analyzer in a Z-direction such that said packets isochronously oscillate in an orthogonal X-direction;

(e) acquiring long spectra corresponding to string duration; and (f) subsequent spectra decoding using the information on predetermined uneven pulse intervals.

12. A method as set forth in claim 11, further comprising one step of the group consisting of: (i) discarding peaks overlapping between series; and (ii) separating partially overlapping peaks based on the information deduced from the non-overlapping peaks in related series and assigning thus separated peaks to the related series.

13. A method as set forth in claim 12, wherein within the pulse string, for any non-equal numbers of start pulses i and j, start times $T_i$ and $T_j$ satisfy one condition of the group: (i) $||T_{i-1}-T_i|-|T_{j+1}-T_j||>\Delta T$; (ii) $T_j=j*T_{12}+T_2*j*(j-1)$, where $T_1>>T_2$; and wherein $T_1$ is from 10 to 100 us and $T_2$ is from 5 to 100 ns.

14. A method as set forth in claim 13, wherein number of start pulses S in said pulse string is selected from the group consisting of: (i) from 3 to 10; (ii) from 10 to 30; (iii) from 30 to 100; (iv) between 100 and 300; and (v) over 300.

15. A method as set forth in claim 14, wherein the ion path between said pulsed ion source and said detector is equal to an integer number of oscillations M within a span ΔM and wherein said spread ΔM in number of reflections is one of the group: (i) from 2 to 3; (ii) from 3 to 10; (iii) from 10 to 30; and (iv) from 30 to 100.

16. A method as set forth in claim 15, further comprising at least one step of the group consisting of: (i) adjusting source emittance under 20 mm2*eV; (ii) accelerating to provide angular-spatial divergence of less than 20 mm*mrad; (iii) adjusting the packet divergence by at least one lens to less than 1 mrad; and (iv) limiting angular divergence by at least two slits within said electrostatic analyzer.

17. A method as set forth in claim 16, wherein said electrostatic analyzer field is formed by at least four electrodes with distinct potentials, and wherein said field comprises at least one spatial focusing field of an accelerating lens such that to provide a time-of-flight focusing relative to small deviations in spatial, angular, and energy spreads of ion packets to an nth order of the Tailor expansion, and further wherein said order of the aberration compensation is selected from the group consisting of: (i) at least first-order, (ii) at least second-order relative to all spreads and including cross terms, and (iii) at least third-order relative to energy spread of ion packets.

18. A method as set forth in claim 17, further comprising a step of ion separation prior to said step of pulsed packets formation, and wherein said upstream separation step comprises one or more of the group consisting of: (i) an ion mobility separation; (ii) a differential mobility separation; (iii) a filter mass spectrometer for passing through one m/z component in a time; (iv) an ion trapping followed by mass dependent sequential release; (v) an ion trapping with a time-of-flight mass separation; and (vi) any of the above separations followed by ion fragmentation.

19. A method as set forth in claim 18, wherein generating a pulse with a main pulse generator further comprises an additional second encoding string of start pulses for synchronizing said step of the upfront ion separation; said second string has non equal intervals between pulses; the duration of said second string is comparable to the duration of said upfront ion separation.

20. A method for spectra decoding in an electrostatic mass spectrometry with coded fast pulsing comprising:

(a) peak picking in the encoded spectrum;

(b) gathering peaks into groups which are spaced in time according to pulse sequence or due to multiplet formation;

(c) validating groups based on the group characteristics and on the integral characteristics of the encoded spectrum, including setting a threshold for a minimum number of peaks in one or more valid groups;

(d) validating individual peaks within the one or more valid groups based on correlation of peak characteristics;

(e) finding peak overlaps between the one or more valid groups and discarding overlaps; and (f) recovering spectra using non-overlapping peaks.

21. A method for spectra decoding as set forth in claim 20, wherein the peaks are sorted into ranges of peak intensity, and wherein identified peaks of higher intensity ranges are removed at analysis of lower intensity ranges.

22. A method for spectra decoding as set forth in claim 21, further comprising one or more of the group consisting of: (i) background subtraction in tandem mass spectrometry spectra prior to spectra decoding; (ii) deconvolution of chromato-mass spectrometric data prior to spectra decoding; (iii) determining correlation between individual peaks.

23. A method for decoding of low intensity spectra in electrostatic mass spectrometry with encoded fast pulsing and comprising:

(a) summing signals spaced according to start pulse intervals for every bin in decoded spectrum;

(b) rejecting sums which have a number of non-zero signals below a preset threshold;

(c) peak detection in the summed spectrum to form hypotheses of correct peaks;

(d) gathering groups of signals corresponding to each hypothesis from the encoded spectrum;

(e) validating said groups based on integral characteristics of the encoded spectrum by setting a threshold for a minimum number of peaks in one or more valid groups;

(f) finding peak overlaps between groups and discarding overlaps; and (g) reconstructing correct spectra using non-overlapping signals.

* * * * *